US006832833B2

(12) United States Patent
Tsuji et al.

(10) Patent No.: US 6,832,833 B2
(45) Date of Patent: Dec. 21, 2004

(54) IMAGE FORMING APPARATUS

(75) Inventors: Masaaki Tsuji, Wakayama (JP); Yoshiyuki Adachi, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 10/383,550

(22) Filed: Mar. 10, 2003

(65) Prior Publication Data

US 2003/0179273 A1 Sep. 25, 2003

(30) Foreign Application Priority Data

Mar. 8, 2002 (JP) ..... 2002-063151
Mar. 8, 2002 (JP) ..... 2002-063294

(51) Int. Cl.[7] ..... B41J 2/01
(52) U.S. Cl. ..... 347/104
(58) Field of Search ..... 347/104, 101; 400/578; 226/10; 399/361

(56) References Cited

U.S. PATENT DOCUMENTS 3,334,722 A 8/1967 Bernard
6,039,481 A 3/2000 Ham

FOREIGN PATENT DOCUMENTS

JP 63-1565 A 1/1988

*Primary Examiner*—Raquel Yvette Gordon
(74) *Attorney, Agent, or Firm*—Smith Patent Office

(57) ABSTRACT

An image forming apparatus of the invention includes carrying means for carrying an image-forming medium; a first position restricting member, unmovable in a widthwise direction of the image-forming medium, for restricting a position of one widthwise end of the image-forming medium carried by the carrying means; a second position restricting member, movable in a widthwise direction of the image-forming medium, for restricting a position of the other widthwise end of the image-forming medium; and an image-forming member for forming an image on the image-forming medium carried by the carrying means, the positions of both widthwise ends of the image-forming medium being restricted by the first position restricting member and the second position restricting member. Accordingly, the positions of both widthwise end of the image-forming medium carried by the carrying means are restricted by the first position restricting member and the second position restricting member.

9 Claims, 12 Drawing Sheets

IMAGE FORMING APPARATUS

BACKGROUND OF THE INVENTION

1. Field of the Invention

The present invention relates to an image forming apparatus for forming an image on an image-forming medium carried.

2. Description of the Related Art

An ink-jet printer injects liquid ink at a paper to print an image thereon. In general, in the ink-jet printer, a long paper is fed on a carrying table disposed to confront a print-head having a number of ink injecting nozzles in sequence from its tip, with its orientation restricted by a pair of guide members disposed at both widthwise end portions of the long paper, to print an image on the paper. In general, the print-head is structured to reciprocally move along a direction perpendicular to a carrying direction of the paper, while injecting the ink at the paper, to print the image thereon.

This type of printer sometimes tries to obtain improved processing power by arranging papers in two rows to confront the print-head so that the image can be printed on those two papers nearly simultaneously. In this arrangement, the widthwise positions of the papers arranged in two rows are restricted separately by two pairs of guide members arranged in correspondence to those two papers, respectively. The two pairs of guide members are each movable along a widthwise direction of the paper (a direction perpendicular to the carrying direction of the paper) so that they can be adjusted in position in accordance with the width of the paper to be in correspondence with both widthwise ends of the paper. This means that the two pairs of guide members positioned in correspondence with the papers arranged in two rows are arranged in parallel with each other on a same plane as a carrying surface of the paper.

Also, each pair of guide members restrict the widthwise position of the paper so that the widthwise center of the paper can conform (center alignment), irrespective of width of the paper. In general, the pair of guide members are movable in a specific range only, so that the distance between the both guide members is not widened beyond a specified distance (maximum distance).

Some carrying table for supporting the papers confronting the print-head is provided with ink receiving portions for receiving the ink protruding from the paper margin when the image is printed on the paper in a rimless form. This type of carrying table is, in general, provided with a number of ink receiving portions disposed adjacent to both ends of the papers having different widths, so as to adequately print the image on the paper in the rimless form regardless of width of the paper.

In this type of printer, when the image is printed on papers arranged in two rows while the print-head is moved forward or backward along the widthwise direction of the papers, as mentioned above, the image is printed on the paper while the print-head is in a position confronting the paper, but the image is not printed on the paper while the print-head is in a position confronting a space between the papers.

If the two pairs of guide members which are movable separately in the widthwise direction of the paper with respect to the papers arranged in two rows are provided in this type of printer, the mechanism for restricting the widthwise position of the paper will be complicated. This problem of complication of the mechanism for restricting the widthwise position of the paper arises not only when the papers are fed in two rows but also when the papers are fed in single row. Also, if the distance between the papers arranged in two rows is large, then the time for the print-head moved forward or backward to be in the position confronting the space between the papers, during which the image is not printed on the paper, becomes longer and, as a result, the processing power of the printer reduces.

Also, if this type of printer is used to print an image on the paper having a larger width than a maximum distance between the pair of guide members, then the both widthwise ends of that wider paper can no longer be restricted by the pair of guide members. Although it is conceivable that the both widthwise ends of that wider paper is restricted by using two guide members of one pair located at the widthwise outside of the guide members of another pair, since the two guide members of another pair located at the widthwise inside are on the carrying surface of such a wider paper, the wider paper will not be fed precisely. Thus, this type of printer cannot feed the paper having a larger width than the maximum distance between the two guide members of the pair, while the both widthwise ends of the paper are restricted on the carrying surface of the paper. As a result, this type of printer cannot be used to print the image on the paper having such a wider width.

SUMMARY OF THE INVENTION

It is one object of the present invention to provide an image forming apparatus that can provide a simplified mechanism for restricting widthwise positions of image-forming media of different widths.

It is another object of the present invention to provide an image forming apparatus that can provide an improved processing power by shortening the time for an image-forming member be in a position confronting the space between the image-forming media during which the image is not formed on the image-forming media.

It is yet another object of the present invention to provide an image forming apparatus that can restrict a widthwise position of each of image-forming media having a relatively narrow width arranged in rows, while carrying the image-forming media, and also can restrict a widthwise position of image-forming media having a width stretching over carrying passages of the image-forming media having the relatively narrow width, while carrying the image-forming media.

In accordance with the first aspect of the present invention, there is provided an image forming apparatus comprising carrying means for carrying an image-forming medium; a first position restricting member, unmovable in a widthwise direction of the image-forming medium, for restricting a position of one widthwise end of the image-forming medium carried by the carrying means; a second position restricting member, movable in a widthwise direction of the image-forming medium, for restricting a position of the other widthwise end of the image-forming medium; and an image-forming member for forming an image on the image-forming medium carried by the carrying means, the positions of both widthwise ends of the image-forming medium being restricted by the first position restricting member and the second position restricting member.

According to this construction, the first position restricting member for restricting a position of one widthwise end of the image-forming medium is unmovable in a widthwise direction of the image-forming medium, while only a second position restricting member for restricting a position of the other widthwise end of the image-forming medium. This construction can allow simplification of the mechanism for restricting the widthwise position of the image-forming medium, as compared with the construction wherein both of the first and second position restricting members are movable in the widthwise direction of the image-forming medium so that the widthwise position of the image-forming medium can be restricted by moving both of the first and second position restricting members.

Suppose that the image forming apparatus is an ink-jet printer wherein the image-forming member injects inks at the image-forming medium to print an image thereon and the image is printed on the image-forming medium of different widths in a rimless form: According to the construction of the invention, one end of the image-forming medium restricted by the first position restricting member can be positioned conformably, irrespective of the width of the image-forming medium. This can provide a common ink receiving portion for any of the image-forming medium of different widths when the ink receiving portion is positioned near the one end of the image-forming medium. This can provide a reduced number of ink receiving portions arranged in the ink-jet printer, and as such can produce simplification of the manufacturing process.

It is preferable that the carrying means carries a plurality of image-forming media arranged in substantially parallel with each other, and wherein at least one of the two first position restricting members and the two second position restricting members, each of which are arranged in correspondence with the two image-forming media arranged adjacent to each other to make a pair, is formed in one piece.

This construction can provide a reduced number of parts for the mechanism for restricting the widthwise position of the image-forming media, and as such can provide further simplification of that mechanism and further reduction of manufacturing costs.

It is preferable that the carrying means carries a plurality of image-forming media arranged in substantially parallel with each other, wherein the image-forming member forms an image while it moves reciprocally along a direction perpendicular to the carrying direction of the image-forming media, and wherein the two first position restricting members, which are arranged in correspondence with the two image-forming media arranged adjacent to each other to make a pair, restrict the positions of the two image-forming media making a pair at their opposing widthwise ends.

According to this construction, the positions of the two image-forming media making a pair at their opposing widthwise ends are restricted by the first position restricting member unmovable in a widthwise direction of the image-forming media. This can provide the result that irrespective of the width of the image-forming media, the two image-forming media making a pair are spaced from each other at a predetermined distance, differently from the case where the widthwise positions of the two image-forming media making a pair are restricted by the center alignment and the case where the positions of the two image-forming media making pair at one widthwise end thereof on the side thereof identical with each other are restricted by the first position restricting member. This can provide the result that when the predetermined distance between the two image-forming media making the pair is set at a shortened distance, the time for the image-forming member to be in the position confronting the space between the image-forming media in the frontward and backward movement of the image-forming member during which no image is printed (the free-running distance at which the image-forming member moves between the image-forming media without printing any image) can be shortened. This can provide an improved processing power of the image forming apparatus.

It is preferable that the first position restricting member can selectively take either a position where at least a part of the first position restricting member locates on the substantially same plane as the carrying surface of the image-forming media or a position where the whole of the first position restricting member does not locate on the substantially same plane as the carrying surface of the image-forming media.

According to this construction, the first position restricting member disposed between the carrying passages of the two image-forming media making the pair is switched from a position where the whole of the first position restricting member does not locate on the substantially same plane as the carrying surface of the image-forming media. This can provide the result that widthwise positions of the image-forming medium having a width spreading across the carrying passages of the two image-forming media making the pair can be properly restricted by the second position restricting member, while the image-forming media is carried.

In accordance with the second aspect of the present invention, there is provided an image forming apparatus comprising carrying means for carrying an image-forming medium; and at least three position restricting members, each of the position restricting members restricting a position of one widthwise end of the image-forming medium, being spaced from one another along a widthwise direction of the image-forming medium, wherein at least one of the at least three position restricting members, except the two position restricting members arranged at outermost positions, can selectively take either a position where at least a part of the position restricting member locates on the substantially same plane as the carrying surface of the image-forming medium or a position where the whole of the position restricting member does not locate on the substantially same plane as the carrying surface of the image-forming medium.

According to this construction, the position restricting member arranged between the position restricting members disposed to be in correspondence with the both widthwise ends of the image-forming media is switched from the position where the whole of the position restricting member does not locate on the substantially same plane as the carrying surface of the image-forming medium. This can provide the result that the positions of both widthwise ends of the image-forming medium having different widths can be properly restricted by the position restricting members, while the image-forming medium is carried.

When a plurality of position restricting members are arranged on the substantially same plane as the carrying surface of the image-forming medium and are spaced from one another along the widthwise direction of the image-forming medium, both widthwise ends of the image-forming medium having different widths can be properly restricted, while the image-forming medium is carried. In a specific range in which the position restricting members are arranged, the image-forming medium having a relatively narrow width can be carried in the condition of being arranged in rows and the image-forming medium having a relatively larger width can be carried in the condition of being carried in a single row.

It is preferable that at least one of the position restricting members is movable in a widthwise direction of the image-forming medium.

According to this construction, since the positions of the position restricting members can be adjusted in accordance with the width of the image-forming medium, the positions of both widthwise ends of the image-forming medium having different widths can be restricted further properly, while the image-forming medium is carried.

It is preferable that at least one of the position restricting members restricts the positions of two image-forcing media arranged adjacent to each other to make a pair at their opposing widthwise ends.

According to this construction, one position restricting member serves as a common member for restricting the widthwise position of the two adjacent image-forming media. This can provide a reduced number of parts of the mechanism for restricting the widthwise positions of the image-forming media, and as such can provide a further simplified mechanism and a reduced manufacturing cost.

It is preferable that there is further provided switching means switches each positions of the position restricting members.

According to this construction, since the position of the position restricting member can be switched by the switching means, the position switching operation of the position restricting member in accordance with various image-forming medium of different widths can be accelerated and facilitated.

It is preferable that the position restricting member switched into the position where the whole of the position restricting member does not locate on the substantially same plane as the carrying surface of the image-forming medium by the switching means is able to abut with an image-forming side or an opposite side of the image-forming medium carried by the carrying means.

According to this construction, the both widthwise ends of the image-forming medium are restricted by the position restricting members arranged to be in correspondence with both widthwise ends of the image-forming media. In addition, the position restricting member switched into the position where the whole of the position restricting member does not locate on the substantially same plane as the carrying surface of the image-forming medium by the switching means be able to abut with the image forming side of the image-forming medium or the opposite side of the same. Therefore, the positions of both widthwise ends of various image-forming medium of different width can be restricted further precisely on the carrying surface of the image-forming medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
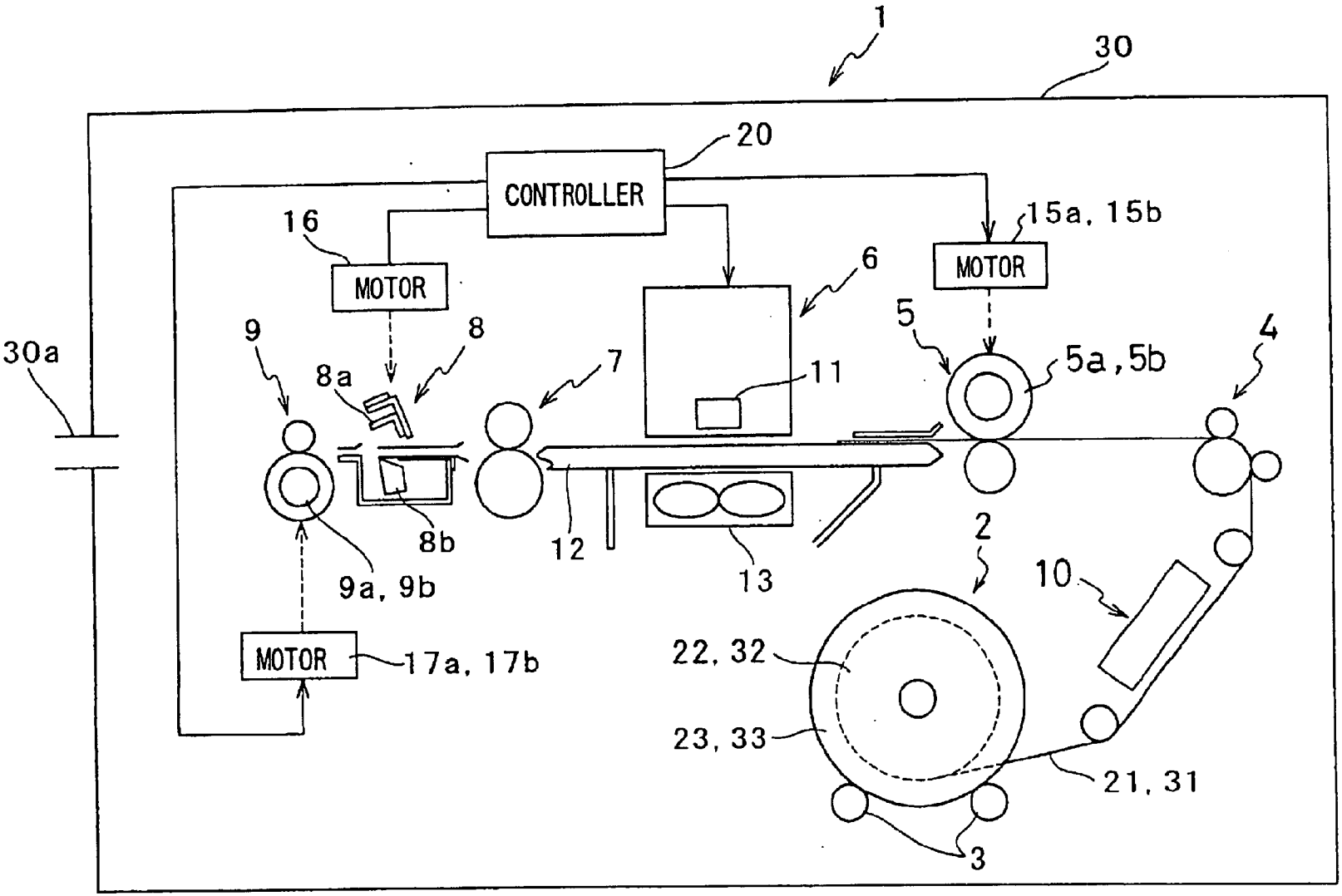
FIG. 1 is a general view of an ink-jet printer according to a first embodiment of the present invention.
Figure 2:
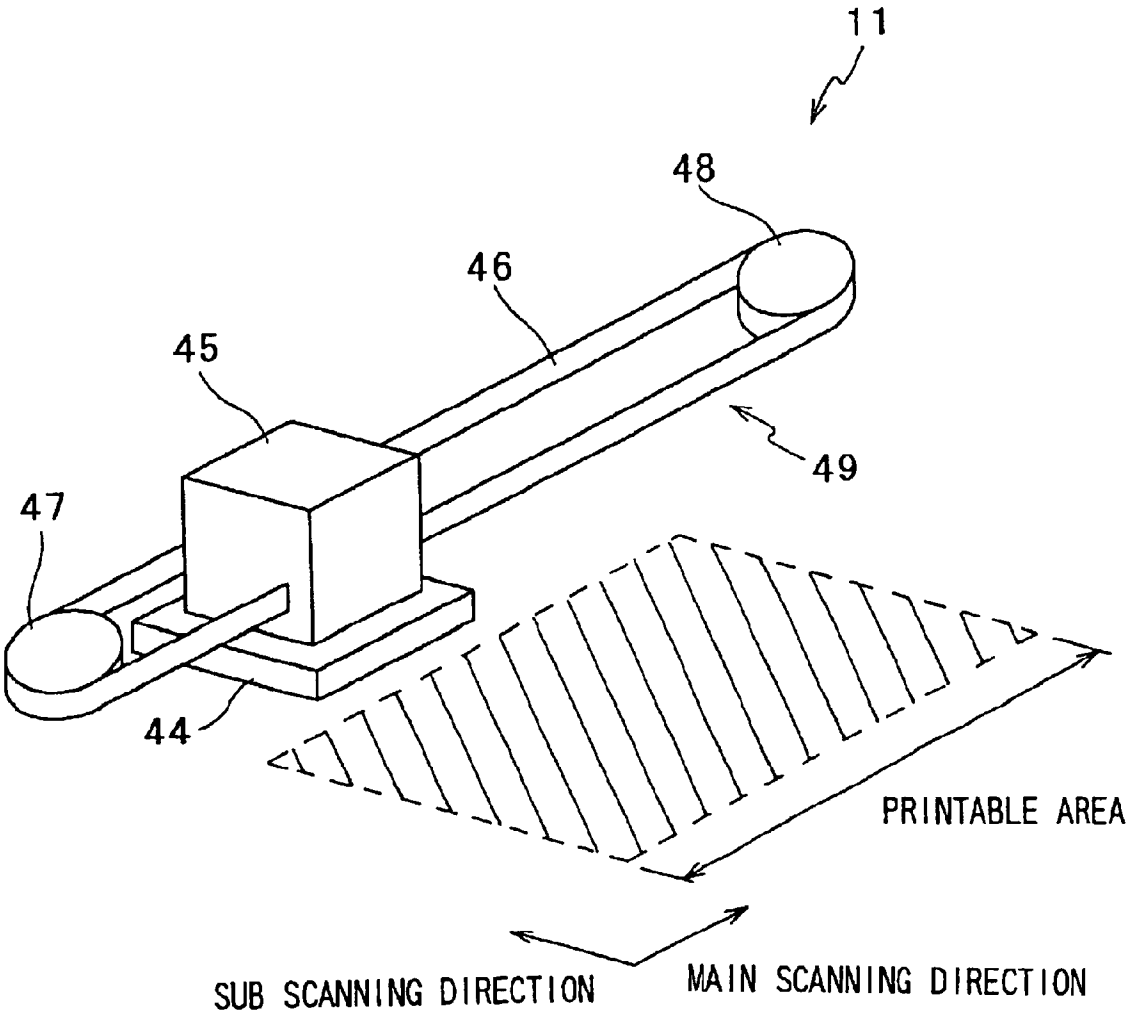
FIG. 2 is a general view of a print-head of the ink-jet printer illustrated in FIG. 1.
Figure 3:
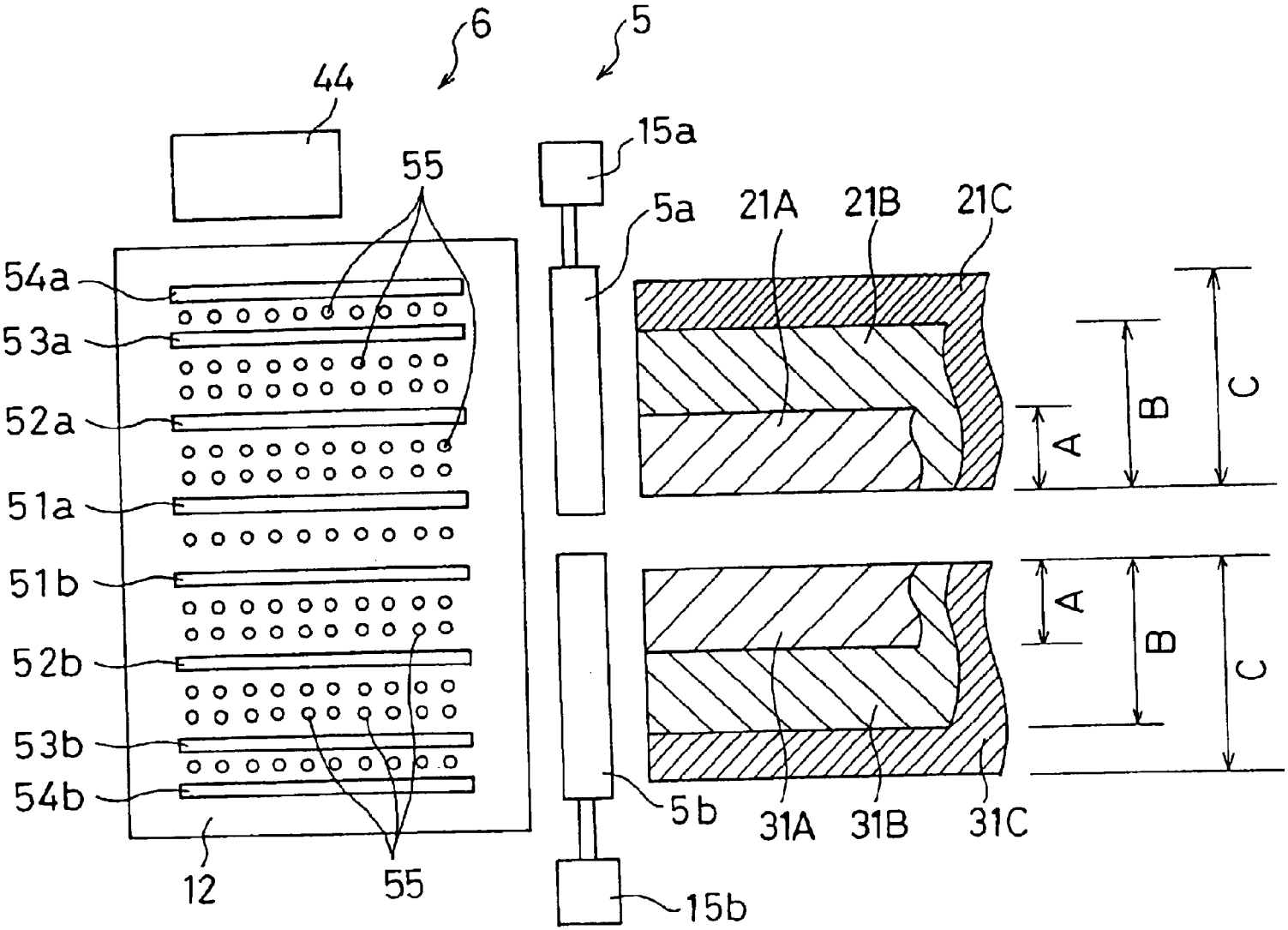
FIG. 3 is a general view of the vicinity of an ink-jet printing unit included in the ink-jet printer illustrated in FIG. 1.
Figure 4:
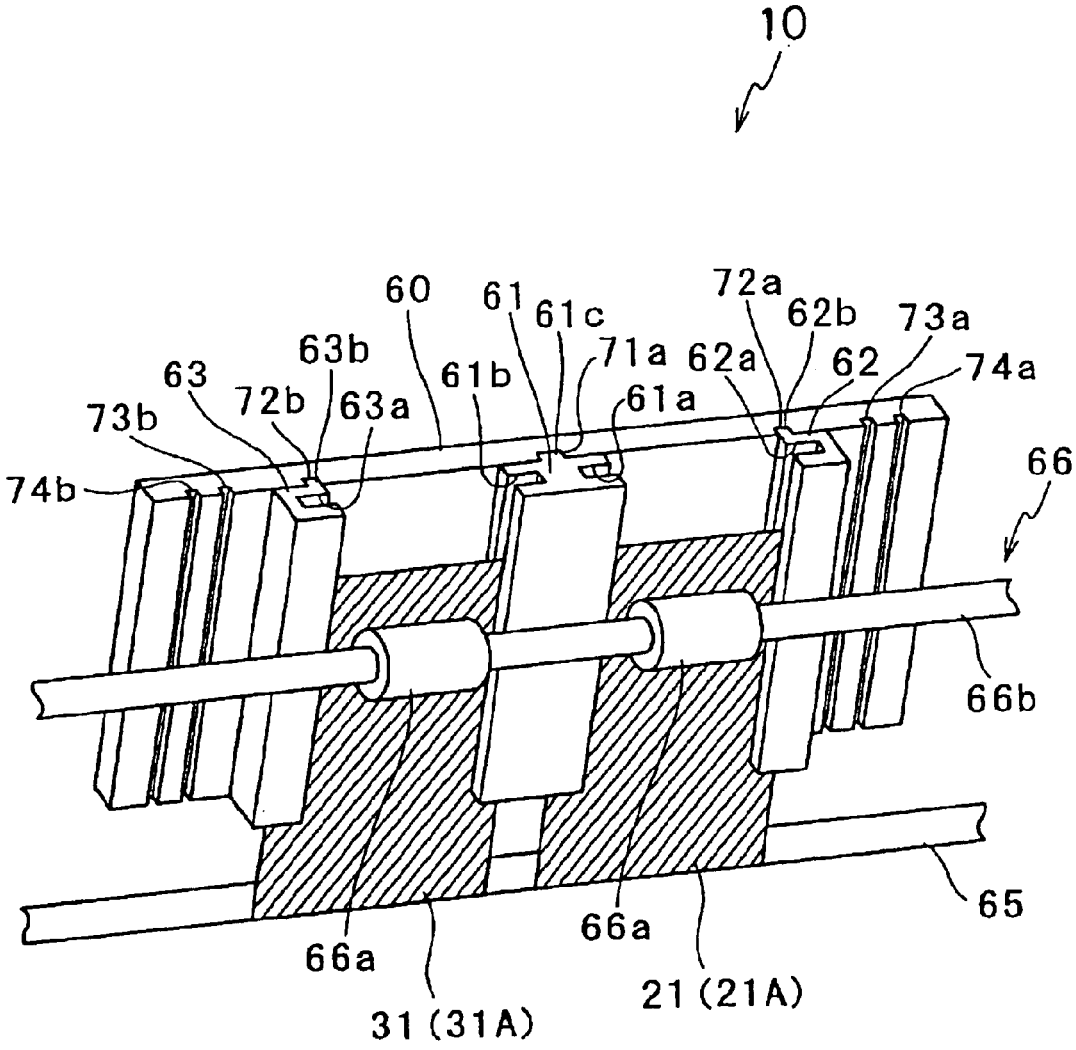
FIG. 4 is a general view of a guide mechanism included in the ink-jet printer illustrated in FIG. 1.

In the following, some preferred embodiments of the present invention will be described with reference to the accompanying drawings. FIG. 1 is a general view of an ink-jet printer according to a first embodiment of the present invention. FIG. 2 is a general view of a print-head of the ink-jet printer illustrated in FIG. 1. FIG. 3 is a general view of the vicinity of an ink-jet printing unit included in the ink-jet printer illustrated in FIG. 1. FIG. 4 is a general view of a guide mechanism included in the ink-jet printer illustrated in FIG. 1.

An ink-jet printer 1 shown in FIG. 1 has, in a nearly rectangular parallelepiped case 30, an advance roller unit 4, a carrying roller unit 5, an ink-jet printing unit 6, a press-contacting roller unit 7, a cutting unit 8, a delivery roller unit 9 and a guide mechanism 10. The case 30 is provided with a paper supply unit 2 loading thereon a winding portion around which a long paper is wound in the shape of a roll. Either one winding portion or two winding portions is/are loaded on the paper supply unit 2 in accordance with the size of the image printed. In the paper supply unit 2 of this embodiment, the winding portions 22, 32, around which the long papers 21, 31 are wound, respectively, are disposed adjacent each other. The winding portions 22, 32 are held on the supply rollers 3 so that they can rotate about their axes, together with a pair of reel plates 23, 33 disposed at both ends thereof. The operations of the respective units of the ink-jet printer 1 are controlled by a controller 20 disposed in the case 30, as mentioned later.

The advance roller unit 4 serves to unwind the papers 21, 31 from the winding portions 22, 32 while they hold front portions of the papers 21, 31 in sandwich relation therebetween. The papers 21, 31 unwound by the advance roller unit 4 are fed to the carrying roller unit 5. After having fed to the carrying roller unit 5, the papers 21, 31 are carried by the carrying roller unit 5.

The guide mechanism 10 detailed later is disposed between the paper supply unit 2 and the advance roller unit 4. The guide mechanism 10 serves to restrict widthwise positions of the papers 21, 31 which are carried while they are unwound from the winding portions 22, 32.

The carrying roller unit 5 has a pair of driving rollers 5*a*, 5*b* driven by motors 15*a*, 15*b* controlled by the controller 20

(See FIG. 3 for each) and is used for carrying the papers 21, 31 before cut by a cutting unit 8. In other words, the carrying roller unit 5 carries the papers 21, 31 unwound from the winding portions 22, 32 further downstream therefrom, passing through the ink-jet printing unit 6 and the cutting unit 8 in sequence.

The ink-jet printing unit 6 has a print-head 11, a carrying table 12, and a suction fan 13. The print-head 11 has a head block 44, a carriage 45 for supporting the head block 44, and a moving mechanism 49 for moving the carriage 45 reciprocally along the main scanning direction (a widthwise direction of the papers 21, 31), as shown in FIG. 2. The moving mechanism 49 includes a circular belt 46 for supporting the carriage 45, and rollers 47, 48 between which the circular belt 46 is extended.

The head block 44 is a flat-plate-like member having, on its surface confronting the papers 21, 31 (on its bottom surface in FIG. 2), a number of nozzles (not shown) for injecting color inks, such as yellow, magenta (purplish red), cyan (blue-green) and black. The head block 44 injects from its nozzles the color inks at surfaces (upper surfaces as views in FIG. 1) of the papers 21, 31 in accordance with signals from the controller 20, to print a desired color image on the papers. The head block 44 injects the inks at the papers 21, 31 to print the image thereon, while moving reciprocally along the main scanning direction in the condition in which the head block 44 is held by the carriage 45 to confront both of the papers 21, 31, as mentioned later. The head block 44 may have only a black ink injecting nozzle to print a monochrome image.

The carriage 45 for supporting the head block 44 is moved reciprocally along the main scanning direction by the moving mechanism 49. The carriage 45 is held by the circular belt 46, as shown in FIG. 2. The circular belt 46 is extended between the rollers 47, 48 rotatable about their respective rotation axes (not shown) fitted therein at the shaft centers thereof. It should be noted that the rollers 47, 48 are spaced from each other with a distance larger than a width of a printable range in the ink-jet printing unit 6 (See FIG. 2). Also, the circular belt 46 is extended to be substantially perpendicular to the sub scanning direction or the carrying direction of the papers 21, 31.

The roller 47 is a driving roller rotationally driven by a motor (not shown), and the roller 48 is a driven roller rotationally driven by rotation of the roller 47 transmitted thereto through the circular belt 46. Therefore, when the roller 47 is rotated, the circular belt 46 is forced to rotate in the same direction. When the roller 47 is rotated in one direction at a predetermined angle, the roller 47 is changed in rotation direction thereat. Then, the roller 47 is rotated in the opposite direction at a predetermined angle and then is changed in rotation direction again. This motion is repeated. This can produce the result that along with the rotation of the roller 47, the circular belt 46 can be moved forward and backward. This permits the carriage 45 to move forward and backward along the main scanning direction between the both widthwise ends of the printable range. It should be noted that the predetermined angle of the roller 47 corresponds to the distance for the carriage 45 to move along the main scanning direction between the both widthwise ends of the printable range.

The print-head 11 of the ink-jet printing unit 6 injects dots of liquid inks from the print-head's nozzles to print the image on the papers 21, 31. The piezo-jet type, the thermal-jet type, or any other types may be adopted as the print-head 11.

The carrying table 12 has a paper carrying surface which is generally equal in level to carrying faces of the papers 21, 31 to support thereon the papers 21, 31 carried by the carrying roller unit 5. The carrying table 12 has recessed portions 51*a*–54*a* and recessed portions 51*b*–54*b* formed to be symmetric with respect to a widthwise center position thereof, as shown in FIG. 3. These recessed portions 51*a*–54*a* and the recessed portions 51*b*–54*b* are ink receiving portions, extending along the carrying direction of the papers 21, 31, for receiving the injected inks protruding from the papers 21, 31 when the image is printed on the papers 21, 31 in the rimless form. It is preferable that the carrying table 12 is provided with a discharge mechanism (not shown) for automatically discharging the inks collected in the recessed portions 51*a*–54*a* and the recessed portions 51*b*–54*b*, or absorbing material (not shown), such as sponges, to absorb the inks collected in the recessed portions 51*a*–54*a* and the recessed portions 51*b*–54*b*. The ink receiving portions provided in the carrying table 12 need not necessarily be the recessed portions. The ink receiving portions may be formed by through holes.

As apparent from FIG. 3, the end of the paper 21 carried by the pair of driving rollers 5*a* of the carrying roller unit 5 is restricted by the guide mechanism 10 so that the end of the papers 21 in the vicinity of the widthwise center of the carrying table 12 or the end of the papers 21 on the side thereof adjacent to the paper 31 arranged in parallel with the paper 21 can be positioned conformably. Therefore, irrespective of the width of the paper 21, the end of the paper 21 in the vicinity of the widthwise center of the carrying table 12 is positioned conformably. Hence, as shown in FIG. 3, the position of the paper 21 having a width A (hereinafter it is referred to as "the paper 21A"), the position of the paper 21 having a width B (hereinafter it is referred to as "the paper 21B") and the position of the paper 21 having a width C (hereinafter it is referred to as "the paper 21C") are restricted, respectively, so that the end of the paper 21A in the vicinity of the widthwise center of the carrying table 12, the end of the paper 21B in the vicinity of the widthwise center of the carrying table 12, and the end of the paper 21C in the vicinity of the widthwise center of the carrying table 12 can conform with each other.

Likewise, the end of the paper 31 carried by the pair of driving rollers 5*b* of the carrying roller unit 5 is restricted so that the end of the papers 31 in the vicinity of the widthwise center of the carrying table 12 or the end of the papers 31 on the side thereof adjacent to the paper 21 arranged in parallel with the paper 31 can be positioned conformably. Therefore, irrespective of the width of the paper 31, the end of the paper 31 in the vicinity of the widthwise center of the carrying table 12 is positioned conformably. Hence, as shown in FIG. 3, the position of the paper 31 having a width A (hereinafter it is referred to as "the paper 31A"), the position of the paper 31 having a width B (hereinafter it is referred to as "the paper 31B") and the position of the paper 31 having a width C (hereinafter it is referred to as "the paper 31C") are restricted, respectively, so that the end of the paper 31A in the vicinity of the widthwise center of the carrying table 12, the end of the paper 31B in the vicinity of the widthwise center of the carrying table 12, and the end of the paper 31C in the vicinity of the widthwise center of the carrying table 12 can conform with each other.

The recessed portions 51*a*–54*a* and the recessed portions 51*b*–54*b* formed in the carrying table 12 are arranged to be in the vicinity of the both widthwise ends of the papers 21A–21C or the papers 31A–31C, respectively. In other words, the recessed portion 51*a* and the recessed portion 52*a* are arranged to be in the vicinity of the both widthwise ends of the paper 21A, respectively. The recessed portion 51*a* and the recessed portion 53*a* are arranged to be in the vicinity of the both widthwise ends of the paper 21B, respectively. The recessed portion 51*a* and the recessed portion 54*a* are arranged to be in the vicinity of the both widthwise ends of the paper 21C, respectively. Likewise, the recessed portion 51*b* and the recessed portion 52*b* are arranged to be in the vicinity of the both widthwise ends of the paper 31A, respectively. The recessed portion 51*b* and the recessed portion 53*b* are arranged to be in the vicinity of the both widthwise ends of the paper 31B, respectively. The recessed portion 51*b* and the recessed portion 54*b* are arranged to be in the vicinity of the both widthwise ends of the paper 31C, respectively.

Thus, the position of the recessed portion 51*a* corresponds to the end of the papers 21A–21C in the vicinity of the widthwise center position of the carrying table 12, irrespective of the width of the paper. Also, the position of the recessed portion 51*b* corresponds to the end of the papers 31A–31C in the vicinity of the widthwise center position of the carrying table 12, irrespective of the width of the paper. The recessed portion 51*a* is used as a common ink receiving portion for the papers 21A–21C on which the image is printed in the rimless form, and the recessed portion 51*b* is used as a common ink receiving portion for the papers 31A–31C on which the image is printed in the rimless form.

A number of circular suction holes 55 are formed in a region of the carrying table 12 where the recessed portions 51*a*–54*a* and the recessed portions 51*b*–54*b* are not formed. The suction holes 55 can be arbitrarily changed in number, shape and arrangement.

The suction fan 13 is disposed to confront the print-head 11 across the carrying passages of the papers 21, 31 so that the papers 21, 31 on the carrying table 12 can be sucked through the suction holes 55 formed in the carrying table 12. Therefore, the papers 21, 31 confronting the print-head 11 are carried in the condition of being sucked by the suction fan 13 located at the back side (the bottom in FIG. 1) of the papers, to closely contact with the carrying table 12. As a result, the space between the papers 21, 31 and the print-head 11 is kept at a regular distance. This is for preventing occurrence of the printing failure resulting from changes in distance between the papers 21, 31 and the print-head 11 caused by the papers 21, 31 being curled to be partly away from the carrying table 12 to a large extent. The suction fan 13 need not necessarily be disposed under the carrying table 12. As long as the suction fan 13 has the capability of adequately sucking the papers 21, 31 on the carrying table 12, the construction and arrangement may be changed arbitrarily.

The press-contacting roller unit 7 is for holding the papers 21, 31 carrying between the ink-jet printing unit 6 and the cutting unit 8 in sandwich relation therebetween. The provision of the press-contacting roller unit 7 between the ink-jet printing unit G and the cutting unit 8 can allow a precise printing by the ink-jet printing unit 6 and a precise cutting of the papers 21, 31 by the cutting unit 8.

The cutting unit 8 has a movable cutting blade 8*a* disposed at the same side as the print-head 11 with respect to the papers 21, 31 and a fixed cutting blade 8*b* disposed to confront the movable cutting blade 8*a* across the papers 21, 31. The movable cutting blade 8*a* and the fixed cutting blade 8*b* are both rectangular-shaped and have a width slightly larger than the printable range of the ink-jet printing unit 6. This allows nearly simultaneous cutting of the papers 21, 31 arranged in two rows. The movable cutting blade 8*a* is moved toward or away from the fixed cutting blade 8*b* by the motor 16 controlled by the controller 20, so that the printed papers 21, 31 carried along the carrying passages from upstream is cut along a widthwise direction thereof by the both blades interacting with each other. As a result, cutting process, the printed papers 21, 31 are split at a predetermined length.

The discharge roller unit 9 has a pair of driving rollers 9*a*, 9*b* driven by motors 17*a*, 17*b* controlled by the controller 20. The discharge roller unit 9 carries the printed papers 21, 31 after cut by the cutting unit 8 and discharges them from a discharge port 30*a*. The pair of driving rollers 9*a*, 9*b* of the discharge roller unit 9 are disposed adjacent to each other along the main scanning direction of the printable range, as is the case with the pair of driving rollers 5*a*, 5*b* of the carrying roller unit 5.

The controller 20 gives a specified process to image signals fed from an input interface (not shown), and then feeds the printing signals, including image data corresponding to the image to be printed, to the ink-jet printing unit 6. Also, the controller 20 can feed driving signals corresponding to a desired carrying distance of the paper to the carrying roller unit 5 and the discharge roller unit 9 at an adequate carrying timing. In addition, the controller 20 can control the printing timing of the ink-jet printing unit 6 and the cutting timing of the cutting unit 8.

Next, the detailed construction of the guide mechanism 10 will be described with reference to FIG. 4. FIG. 4 illustrates the state in which the papers 21A, 21B are being carried.

The guide mechanism 10 is disposed between the paper supply unit 2 and the advance roller unit 4, as mentioned above. The guide mechanism 10 serves to restrict the widthwise positions of the papers 21, 31 unwound from the winding portions 22, 32 and carried in two rows parallel with each other.

The guide mechanism 10 has a guide supporting plate 60, a fixed guide member 61 and two movable guide members 62, 63 and driven rollers 65, 66.

The fixed guide member 61 is disposed at a widthwise center of a bottom of the guide supporting plate 60. The guide supporting plate 60 and the carrying table 12 are disposed so that the widthwise center position of the guide supporting plate 60 and the widthwise center position of the carrying table 12 can correspond to each other. The fixed guide member 61 is a member having a nearly rectangular parallelepiped shape to restrict the position of the end of the papers 21, 31 in the vicinity of the widthwise center position of the guide supporting plate 60. The fixed guide member 61 is provided, on both widthwise sides thereof, with grooves 61*a*, 61*b* extending along the longitudinal direction thereof. The groove 61*a* is formed in the fixed guide member 61 at its side on the side thereof on which the paper 21 is carried, and the groove 61*b* is formed in the fixed guide member 61 at a side thereof on the side on which the paper 31 is carried. Accordingly, the fixed guide member 61 has a nearly "H-shaped" section taken along line perpendicular to the longitudinal direction of the fixed guide member 61. The papers 21, 31 are carried in the condition in which their ends in the vicinity of the widthwise center of the guide supporting plate 60 are inserted in their respective grooves 61*a* and 61*b* of the fixed guide member 61, so that the widthwise ends of the papers 21, 31 are restricted.

The guide supporting plate 60 is provided, on its bottom, with mounting portions 71*a*, 72*a*–74*a*, 72*b*–74*b* formed by recessed portions extending along the carrying direction of the papers 21, 31. The mounting portion 71*a* is provided at a position in the vicinity of the widthwise center of the guide supporting plate 60. The mounting portions 72*a*–74*a* and the mounting portions 72*b*–74*b* are provided at positions corresponding to the ends of the papers 21A–21C and the ends of the papers 31A–31C in the vicinity of the widthwise outer ends of the guide supporting plate 60, respectively. In other words, the mounting portions 72*a*–74*a* and the mounting portions 72*b*–74*b* are disposed on the bottom of the guide supporting plate 60 in such a relation as to sandwich the mounting portion 71*a* therebetween.

The fixed guide member 61 is provided, on a side thereof on the guide supporting plate 60 side, with a projection 61*c* extending along the longitudinal direction thereof. The projection 61*c* of the fixed guide member 61 has a width substantially equal to a width of the mounting portion 71*a* of the guide supporting plate 60. The fixed guide member 61 can be mounted on the guide supporting plate 60 by inserting the entire projection 61*c* of the fixed guide member 61 into the mounting portion 71*a*. This means that the fixed guide member 61 is detachably mounted on the guide supporting plate 60.

The movable guide members 62, 63 are a member having a nearly rectangular parallelepiped shape to restrict the positions of the other ends of the papers 21, 31 on the opposite side to the ends of the papers 21, 31 restricted by the fixed guide member 61. The movable guide members 62, 63 are provided, on both widthwise inner sides thereof, with grooves 62*a*, 63*a* extending along the longitudinal direction. Accordingly, the movable guide members 62, 63 each have a generally "U-shaped" section taken along line perpendicular to the longitudinal direction of the movable guide members 62, 63. The groove 62*a* of the movable guide member 62 is formed to confront the groove 61*a* of the fixed guide member 61, and the groove 63*a* of the movable guide member 63 is formed to confront the groove 61*b* of the fixed guide member 61.

The movable guide members 62, 63 can be detachably mounted on the mounting portions 72*a*–74*a* and the mounting portions 72*b*–74*b*, respectively, as mentioned later. Hence, the movable members 62, 63 can be disposed in accordance with the widths of the papers 21, 31, with the fixed guide member 61 sandwiched between the movable members 62, 63 on the bottom of the guide supporting plate 60. Accordingly, the papers 21, 31 can be carried in the condition in which their ends at the widthwise outer sides of the guide supporting plate 60 are inserted in the groove 62*a* of the movable guide member 62 and the groove 63*b* of the movable guide member 63, respectively, so that the widthwise ends of the papers 21, 31 are restricted.

The movable guide members 62, 63 are provided, on a side thereof on the guide supporting plate 60 side, with projections 62*b*, 63*b* extending along the longitudinal direction thereof. The projections 62*b*, 63*b* of the movable guide members 62, 63 have widths substantially equal to widths of the mounting portions 72*a*–74*a* and the mounting portions 72*b*–74*b* of the guide supporting plate 60, respectively. The movable guide members 62, 63 can be mounted on the guide supporting plate 60 by inserting the entire projection 62*b* of the movable guide member 62 into the mounting portions 72*a*–74*a* or by inserting the entire projection 63*b* of the movable guide member 63 into the mounting portions 72*b*–74*b*. This means that the movable guide members 62, 63 are detachably mounted on the guide supporting plate 60.

When the movable guide member 62 is mounted on the mounting portion 72*a*, the positions of both widthwise ends of the paper 21A can be restricted by the fixed guide member 61 and the movable guide member 62. When the movable guide member 62 is mounted on the mounting portion 73*a*, the positions of both widthwise ends of the paper 21B can be restricted by the fixed guide member 61 and the movable guide member 62. When the movable guide member 62 is mounted on the mounting portion 74*a*, the positions of both widthwise ends of the paper 21C can be restricted by the fixed guide member 61 and the movable guide member 62.

Likewise, when the movable guide member 63 is mounted on the mounting portion 72*b*, the positions of both widthwise ends of the paper 31A can be restricted by the fixed guide member 61 and the movable guide member 63. When the movable guide member 63 is mounted on the mounting portion 73*b*, the positions of both widthwise ends of the paper 31B can be restricted by the fixed guide member 61 and the movable guide member 63. When the movable guide member 63 is mounted on the mounting portion 74*b*, the positions of both widthwise ends of the paper 31C can be restricted by the fixed guide member 61 and the movable guide member 63.

The driven roller 65 is disposed in the upstream of the guide supporting plate 60 (downward in FIG. 4) with respect to the carrying direction of the papers 21, 31, to change the carrying direction of the papers 21, 31 unwound from the winding portions 22, 32 to a direction parallel with the guide supporting plate 60 (the guide mechanism 10).

The driven roller 66 includes two cylindrical roller portions 66*a* confronting the bottom of the guide supporting plate 60 and located between the fixed guide member 61 and the movable guide member 62 and between the fixed guide member 61 and the movable guide member 63, respectively, and a shaft member 66*b* on which the roller portions 66*a* are fitted and which is rotatably supported. Further, the driven roller 66 is arranged such that the surface of the roller portions 66*a* are brought into contact with the surface of the papers 21, 31 carried in the guide mechanism 10. The driven roller 66 has the function of carrying the papers 21, 31 properly which are carried with their widthwise positions restricted by the fixed guide member 61 and the movable guide member 63 and by the fixed guide member 61 and the movable guide member 63, respectively.

When the fixed guide member 61 is detached from the guide supporting plate 60, a paper having a width much larger than the papers 21A–21C and the papers 31A–31C having the width A–C can be carried in the condition in which the positions of that paper at both widthwise ends thereof are restricted. In other words, when the movable guide member 62 is fixed to the mounting portion 72*a* and the movable guide member 63 is fixed to the mounting portion 72*b*, a paper having a width nearly corresponding to the space between a bottom of the groove 62*a* and a bottom of the groove 63*a* defined when the movable guide members 62, 63 are fixed to the mounting portions 72*a*, 72*b*, respectively, can be carried in the condition in which the positions of that paper at both widthwise ends thereof are restricted. Further, when the movable guide member 62 is fixed to the mounting portion 73*a* and the movable guide member 63 is fixed to the mounting portion 73*b*, or when the movable guide member 62 is fixed to the mounting portion 74*a* and the movable guide member 63 is fixed to the mounting portion 74*b*, a paper having an even larger width can be carried in the condition in which the positions of that paper at both widthwise ends thereof are restricted. Thus, various papers different in width can be properly carried by various combinations of the mounting portions 72*a*–74*a* to which the movable guide member 62 is fixed and the mounting portions 72*b*–74*b* to which the movable guide member 63 is fixed.

As mentioned above, in the guide mechanism 10 of the ink-jet printer of this embodiment, the fixed guide member 61 is fixed to restrict the positions of the papers 21, 31 at ends thereof in the vicinity of the widthwise center of the guide supporting plate 60, and only the movable guide members 62, 63 for restricting the positions of the papers 21, 31 at ends thereof in correspondence with the widthwise outer ends of the guide supporting plate 60 are movable in the widthwise direction of the papers 21, 31. This arrangement can provide a simplified guide mechanism 10 for restricting the widthwise positions of the papers 21, 31, as compared with the arrangement wherein the fixed guide member 61 and the movable guide members 62, 63 are both movable in the widthwise direction of the papers 21, 31.

When the image is printed on the papers 21A–21C and the papers 31A–31C in the rimless form, the papers 21, 31 at ends thereof in the vicinity of the widthwise center of the carrying table 12 are positioned conformably, irrespective of the width of the papers 21, 31, so that the recessed portions 51*a*, 51*b* are used as the common ink receiving portion for any the papers 21, 31. This can provide a reduced number of ink receiving portions arranged in the carrying table 12 of the ink-jet printer 1, and as such can provide a simplified manufacturing process.

Also, since the positions of the papers 21, 31 at ends thereof in the vicinity of the widthwise center of the carrying table 12, i.e., the positions of the papers 21, 31 at ends thereof on the side thereof adjacent to each other, are restricted by the fixed guide member 61, the papers 21, 31 are spaced from each other at a fixed distance, differently from the case where the widthwise positions of the papers 21, 31 are restricted by the center alignment and the case where the positions of the papers 21, 31 at one widthwise end thereof on the side thereof identical with each other are restricted by the fixed guide member 61. This can provide the result that when this fixed distance is set at a shortened distance, the time for the head block 44 to be in the position confronting the space between the papers 21, 31 in the frontward and backward movement of the head block 44 during which no image is printed (the free-running distance at which the head block 44 moves between the papers 21, 31 without printing any image) can be shortened. This can provide an improved processing power of the ink-jet printer 1.

Also, since the fixed guide member 61 is formed in one piece as a common guide member for restricting the positions of the papers 21, 31 at ends thereof in the vicinity of the widthwise center of the guide supporting plate 60, parts count of the guide mechanism 10 for restricting the widthwise positions of the papers 21, 31 can be reduced. This can provide a further simplified guide mechanism 10 and reduced manufacturing costs.

Figure 5:
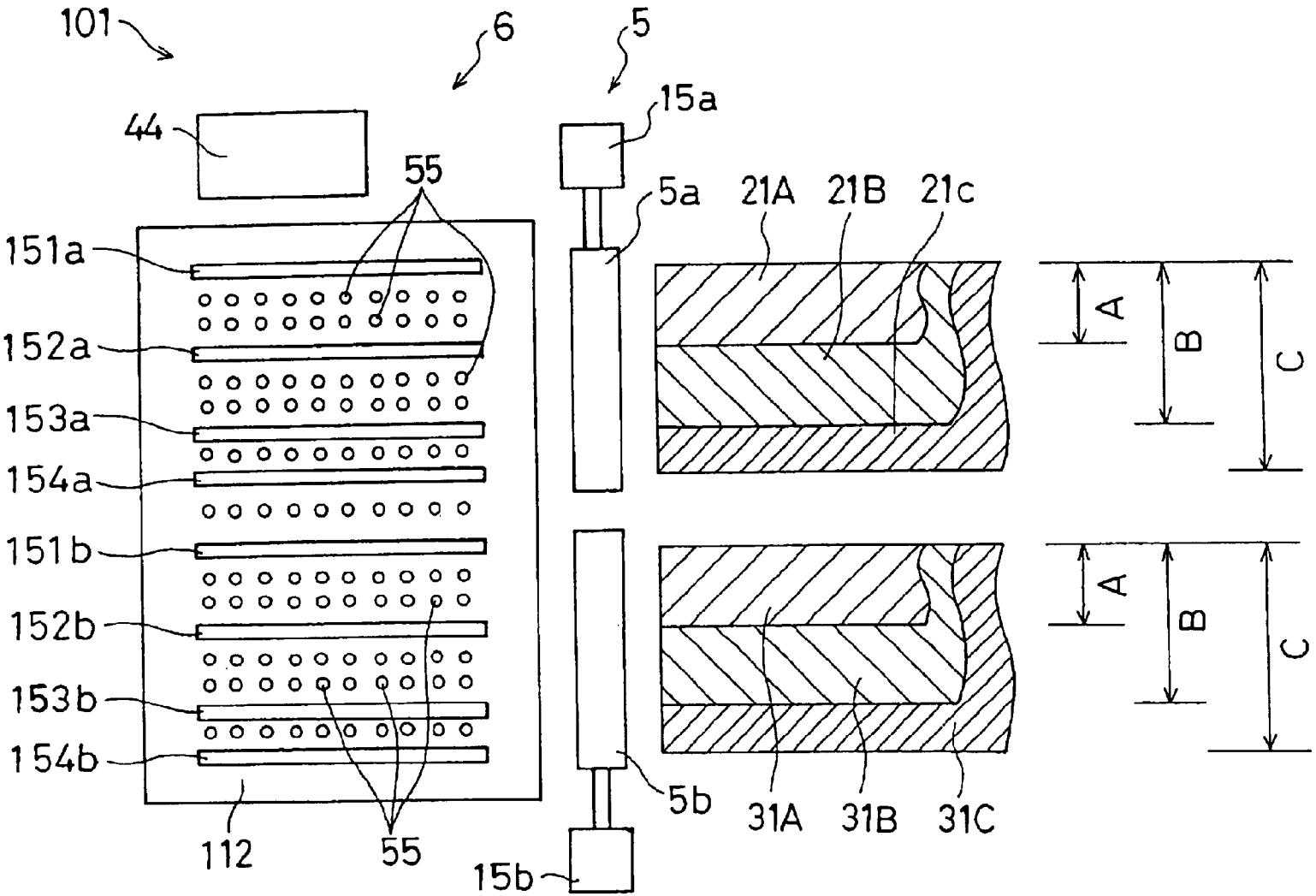
FIG. 5 is a general view of the vicinity of an ink-jet printing unit included in an ink-jet printer according to a second embodiment of the present invention.
Figure 6:
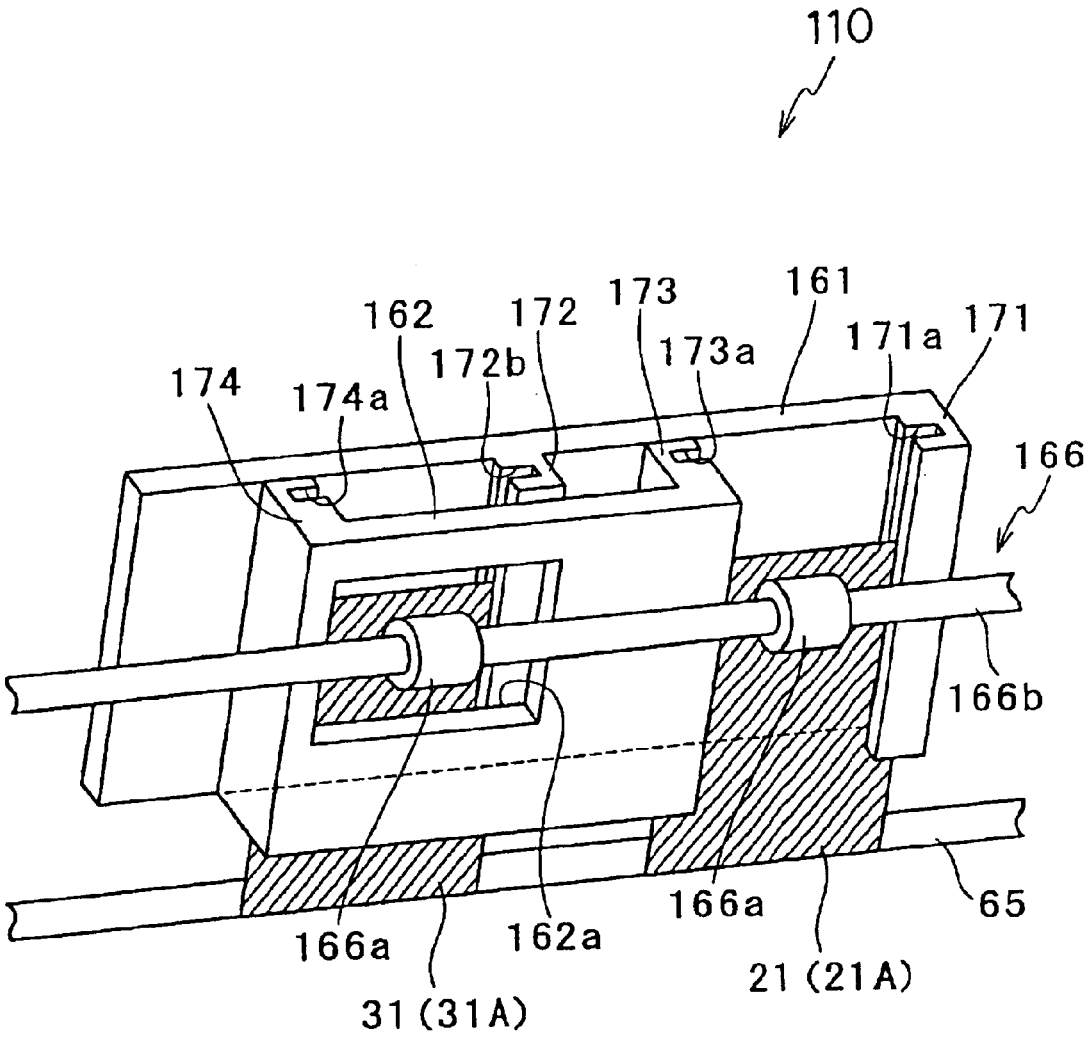
FIG. 6 is a general view of a guide mechanism included in the ink-jet printer of the second embodiment of the present invention.

Next, a second embodiment of the present invention will be described with reference to the drawings. FIG. 5 is a general view of the vicinity of an ink-jet printing unit included in an ink-jet printer according to a second embodiment of the present invention. FIG. 6 is a general view of a guide mechanism included in the ink-jet printer of the second embodiment of the present invention.

The ink-jet printer 101 of the second embodiment is different from the ink-jet printer 1 of the first embodiment in the following point. In the ink-jet printer 1, the papers 21A–21C and the papers 31A–31C are restricted by the guide mechanism 10 so that the positions of the papers 21, 23 at ends thereof on the side thereof adjacent to each other (the ends in the vicinity of the widthwise center of the carrying table 12) can conform with each other. In contrast to this, in the ink-jet printer 101, the papers 21A–21C and the papers 31A–31C are restricted by the guide mechanism 110 so that their positions at ends thereof on the side thereof adjacent to one end of the carrying table 112 (the upper end in FIG. 5) can conform with each other. The guide mechanism 110 is disposed between the paper supply unit 2 and the advance roller unit 4, as is the case with the guide mechanism 10. As the other constructions of the ink-jet printer 101 is the same as those of the ink-jet printer 1 of FIG. 1, like parts are labeled with like numerals and the description thereon is omitted.

The carrying table 112 is provided with recessed portions 151*a*–154*a* and recessed portions 151*b*–154*b* formed to be asymmetric with respect to a widthwise center thereof, as shown in FIG. 5.

The papers 21 carried by the pair of driving rollers 5*a* of the carrying roller unit 5 are restricted so that their ends on the side thereof adjacent to one end of the carrying table 112 (the upper end in FIG. 5) can conform with each other. Therefore, irrespective of the width of the paper 21, the positions of the papers 21 at their widthwise end on the side thereof adjacent to one end of the carrying table 112 conform with each other. Likewise, the papers 31 carried by the pair of driving rollers 5*b* of the carrying roller unit 5 are restricted so that their widthwise ends on the side thereof adjacent to one end of the carrying table 112, i.e., their widthwise ends on the side thereof adjacent to the paper 21 arranged in parallel with the paper 31, can conform with each other. Therefore, irrespective of the width of the paper 31, the positions of the papers 31 at their widthwise end on the side thereof adjacent to one end of the carrying table 112 conform with each other.

The recessed portions 151*a*–154*a* and recessed portions 151*b*–154*b* formed in the carrying table 112 are arranged to be in the vicinity of the both widthwise ends of the papers 21A–21C or the papers 31A–31C, respectively, as is the case with the first embodiment. In other words, the recessed portion 151*a* and the recessed portion 152*a* are arranged to be in the vicinity of the both widthwise ends of the paper 21A, respectively. The recessed portion 151*a* and the recessed portion 153*a* are arranged to be in the vicinity of the both widthwise ends of the paper 21B, respectively. The recessed portion 151*a* and the recessed portion 154*a* are arranged to be in the vicinity of the both widthwise ends of the paper 21C, respectively. Likewise, the recessed portion 151*b* and the recessed portion 152*b* are arranged to be in the vicinity of the both widthwise ends of the paper 31A, respectively. The recessed portion 151*b* and the recessed portion 153*b* are arranged to be in the vicinity of the both widthwise ends of the paper 31B, respectively. The recessed portion 151*b* and the recessed portion 154*b* are arranged to be in the vicinity of the both widthwise ends of the paper 31C, respectively.

Thus, the recessed portion 151*a* corresponds in position to the end of any of the papers 21A–21C in the vicinity of the one end of the carrying table 112, and the recessed portion 151*b* corresponds in position to the end of any of the papers 31A–31C in the same side of the one end of the carrying table 12. The recessed portion 151*a* is used as a common ink receiving portion for the papers 21A–21C on which the image is printed in the rimless form, and the recessed portion 151*b* is used as a common ink receiving portion for the papers 31A–31C on which the image is printed in the rimless form.

The guide mechanism 110 has a fixed guide supporting plate 161 having fixed guide portions 171, 172, a movable guide supporting plate 162 having movable guide portions 173, 174, and driven roller 65, 166, as shown in FIG. 6.

The fixed guide portions 171, 172 are provided in the bottom of the fixed guide supporting plate 161 at one end thereof and at a widthwise center portion thereof, respectively. One end of the fixed guide supporting plate 161 corresponds to one end of the carrying table 112, which is disposed adjacent to the one end of the same when the papers 21 are restricted so that their ends can be positioned conformably. The fixed guide portions 171, 172 are projections having a generally rectangular parallelepiped shape to restrict the position of the papers 21, 31 at one end thereof on the side of the one end of the fixed guide supporting plate 161. The fixed guide portions 171, 172 are provided with grooves 171*a*, 172*a* extending along the longitudinal direction which are formed in their side surfaces on the same side as the other end of the fixed guide supporting plate 161, respectively. Accordingly, the fixed guide portions 171, 172 have a generally "U-shaped" section taken along line perpendicular to the longitudinal direction of the fixed guide portions 171, 172. The papers 21, 31 are carried in the condition in which their ends on the side of one end of the fixed guide supporting plate 161 are inserted in the grooves 171*a*, 172*a* of the fixed guide portions 171, 172, so that the widthwise positions of the ends of the papers 21, 31 are restricted.

The movable guide supporting plate 162 is disposed to confront the bottom of the fixed guide supporting plate 161 and is provided with the movable guide portions 173, 174 formed on its confronting surface (the upper side in FIG. 6) at both ends thereof. The movable guide members 173, 174 are projections having a generally rectangular parallelepiped shape to restrict the positions of ends of the papers 21, 31 on the side thereof opposite the ends of the papers 21, 31 restricted by the fixed guide portions 171, 172. The movable guide portions 173, 174 are provided with grooves 173*a*, 174*a* extending along the longitudinal direction which are formed in their side surfaces on the side of the one end of the fixed guide supporting plate 161, respectively. Accordingly, the movable guide portions 173, 174 have a generally "U-shaped" section taken along line perpendicular to the longitudinal direction of the movable guide portions 173, 174. The groove 173*a* of the movable guide portion 173 is formed to confront the groove 171*a* of the fixed guide portion 171, and the groove 174*a* of the movable guide portion 174 is formed to confront the groove 172*a* of the fixed guide portion 172. The papers 21, 31 are carried in the condition in which their ends on the side of the other end of the fixed guide supporting plate 161 are inserted in the groove 173*a* of the movable guide portion 173 or the groove 174*a* of the movable guide portion 174, so that the widthwise positions of the ends of the papers 21, 31 are restricted.

The movable guide supporting plate 162 is structured to move along a widthwise direction of the fixed guide supporting plate 161. Accordingly, the distance between the fixed guide portion 171 and the movable guide portion 173 and the distance between the fixed guide portion 172 and the movable guide portion 174 can be changed arbitrarily. In other words, the position of the movable guide portions 173, 174 of the movable guide supporting plate 162 can be adjusted to be in correspondence with the widths of the papers 21, 31. The movable guide supporting plate 162 is fixed to the fixed guide supporting plate 161 by a clamp (not shown) after adjusted in position. The position of the movable guide supporting plate 162 can be re-adjusted by releasing the fixation by the clamp.

The driven roller 166 includes two cylindrical roller portions 166*a* confronting the bottom of the fixed guide supporting plate 161 and located between the fixed guide portion 171 and the movable guide portion 173 and between the fixed guide portion 172 and the movable guide member 174, respectively, and a shaft member 166*b* on which the roller portions 166*a* are fitted and which is rotatably supported. The driven roller 166 is disposed at the opposite side to the fixed guide supporting plate 161 with respect to the movable guide supporting plate 162. Also, the driven roller 166 is disposed so that their roller portions 166*a* can abut with surfaces of the papers 21, 31 carrying through the guide mechanism 104. The driven roller 166 has the capability of carrying the papers 21, 31 properly which are carried with their widthwise positions restricted by the fixed guide portion 171 and the movable guide portion 173 and by the fixed guide member 172 and the movable guide member 174, respectively.

The movable guide supporting plate 162 has a rectangular opening 162*a* formed to be larger than the roller portion 166*a*. The roller portion 166*a* on the side of the other end of the fixed guide supporting plate 161 is disposed to be in the opening 162*a*. This allows the two roller portions 166*a* to both contact with the papers 21, 31 carried between the fixed guide supporting plate 161 and the movable guide supporting plate 162.

In the guide mechanism 110 of the ink-jet printer 101 of this embodiment thus constructed, the fixed guide portions 171, 172 for restricting the positions of the papers 21, 31 at their ends on the side of one end of the fixed guide supporting plate 161 are fixed, while only the movable guide portions 173, 174 for restricting the positions of the papers 21, 31 at their ends on the side of the other end of the fixed guide supporting plate 161 are movable in the widthwise direction of the papers 21, 31, as in the case with the first embodiment. This construction can allow simplification of the guide mechanism 110 for restricting the widthwise positions of the papers 21, 31.

When an image is printed on the papers 21A–21C and the papers 31A–31C in a rimless form, the positions of the paper ends on the side of one end of the carrying table 112 can conform with each other, irrespective of the width of the paper 21, 31. This can provide the result that the recessed portions 151*a*, 151*b* arranged in the vicinity of the paper ends can be used as a common ink receiving portion for any of the papers 21, 31 of different widths. This can provide a reduced number of ink receiving portions arranged in the carrying table 112 of the ink-jet printer 101, and as such can produce simplification of the manufacturing process.

Also, the fixed guide portions 171, 172 are both provided on the fixed guide supporting plate 161 and the movable guide portions 173, 174 are both provided on the movable guide supporting plate 162. In addition to this, the fixed guide portions 171, 172 are integrally formed as a common guide member and the movable guide portions 173, 174 are also integrally formed as a common guide member. This construction can provide a reduced number of parts count for the guide mechanism 110 for restricting the widthwise position of the papers 21, 31, and as such can provide further simplification of the guide mechanism 110 and further reduction of manufacturing costs.

Figure 7:
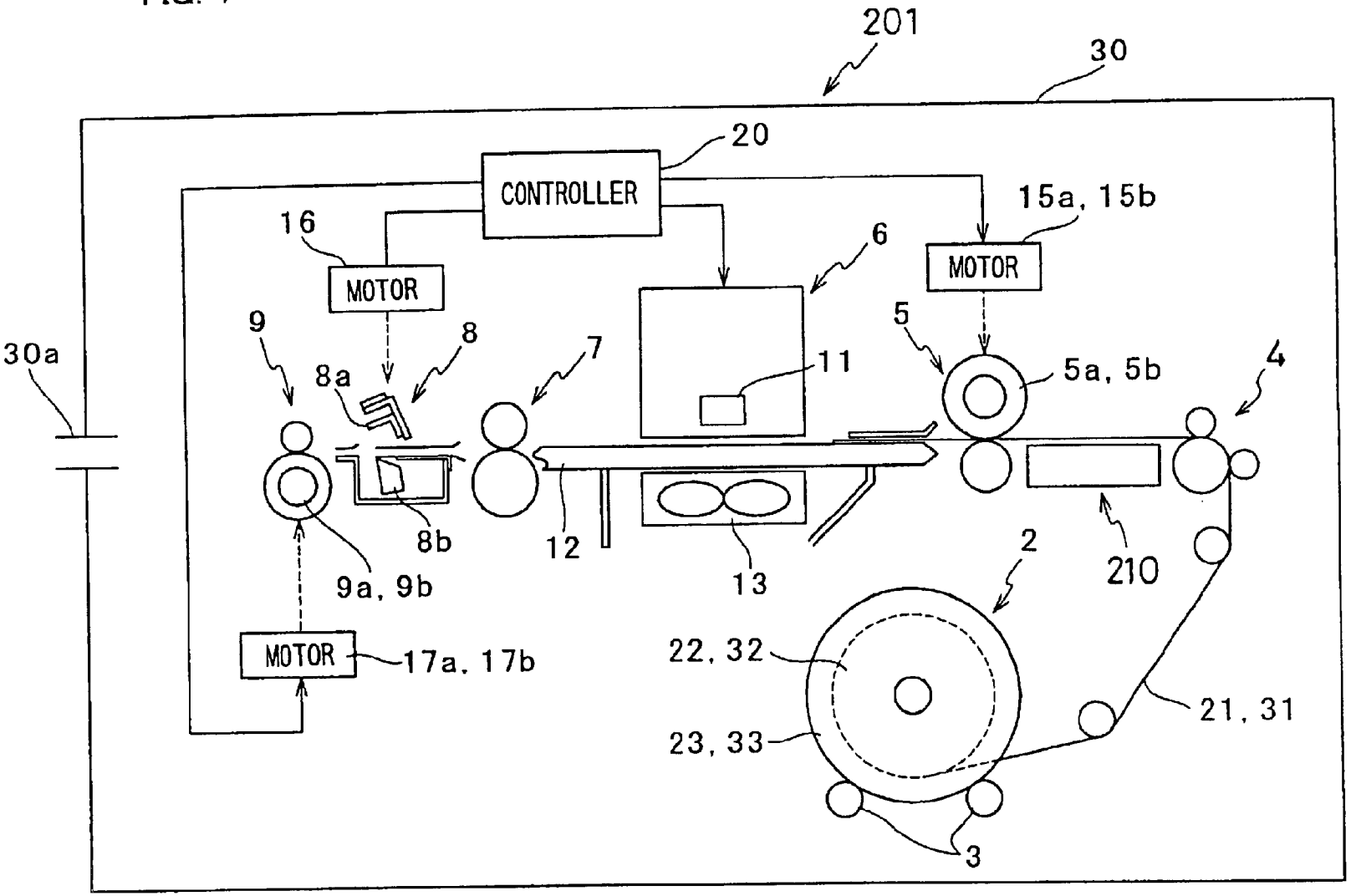
FIG. 7 is a general view of an ink-jet printer according to the third embodiment of the present invention (two winding portions are loaded)
Figure 8:
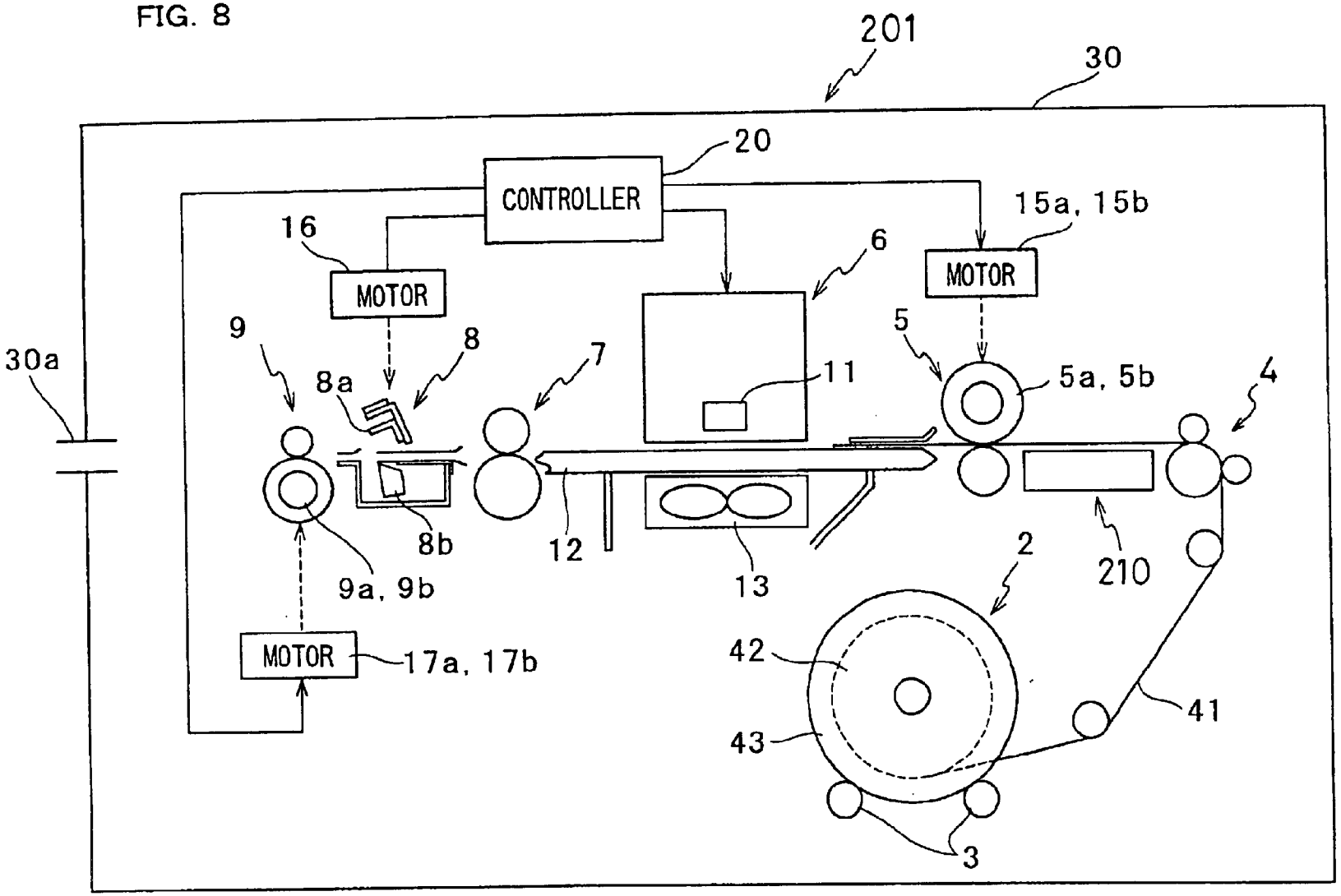
FIG. 8 is a general view of an ink-jet printer according to a third embodiment of the present invention (one winding portion is loaded)

Next, a third embodiment of the present invention will be described with reference to the drawings FIG. 7 is a general view of an ink-jet printer according to a third embodiment of the present invention (two winding portions are loaded). FIG. 8 is a general view of an ink-jet printer according to the third embodiment of the present invention (one winding portion is loaded).

The ink-jet printer 201 of the third embodiment is different from the ink-jet printer 1 of the first embodiment in the following point. In the ink-jet printer 1, the guide mechanism 10 is located between the paper supply unit 2 and the advance roller unit 4. In contrast to this, in the ink-jet printer 201, the guide mechanism 210 is located between the advance roller unit 4 and the carrying roller unit 5. As the other constructions of the ink-jet printer 201 is the same as those of the ink-jet printer 1 of FIG. 1, like parts are labeled with like numerals and the description thereon is omitted.

FIG. 7 illustrates the state that two winding portions 22, 32 around which the long papers 21, 32 are wound, respectively, are loaded in the paper supply unit 2 to be adjacent to each other with respect to the horizontal direction, as is the case with the first embodiment. On the other hand, FIG. 8 illustrates the state that a single winding portion 42 around which a long paper 41 is wound is loaded in the paper supply unit 2. The winding portion 42 is held on the supply rollers 3 in such a manner as to rotate about its axis, together with a pair of reel plates 43 disposed at both ends thereof. It is to be noted that the paper 41 has a width larger than a sum of the widths of the both papers 21, 31, as mentioned later.

The guide mechanism 210 is located between the advance roller unit 4 and the carrying roller unit 5 to restrict the both widthwise ends of the paper(s) unwound from the winding portion(s) loaded in the paper supply unit 2 and carried.

Next, the detailed construction of the guide mechanism 210 will be described with reference to FIGS. 9–12.

Figure 9:
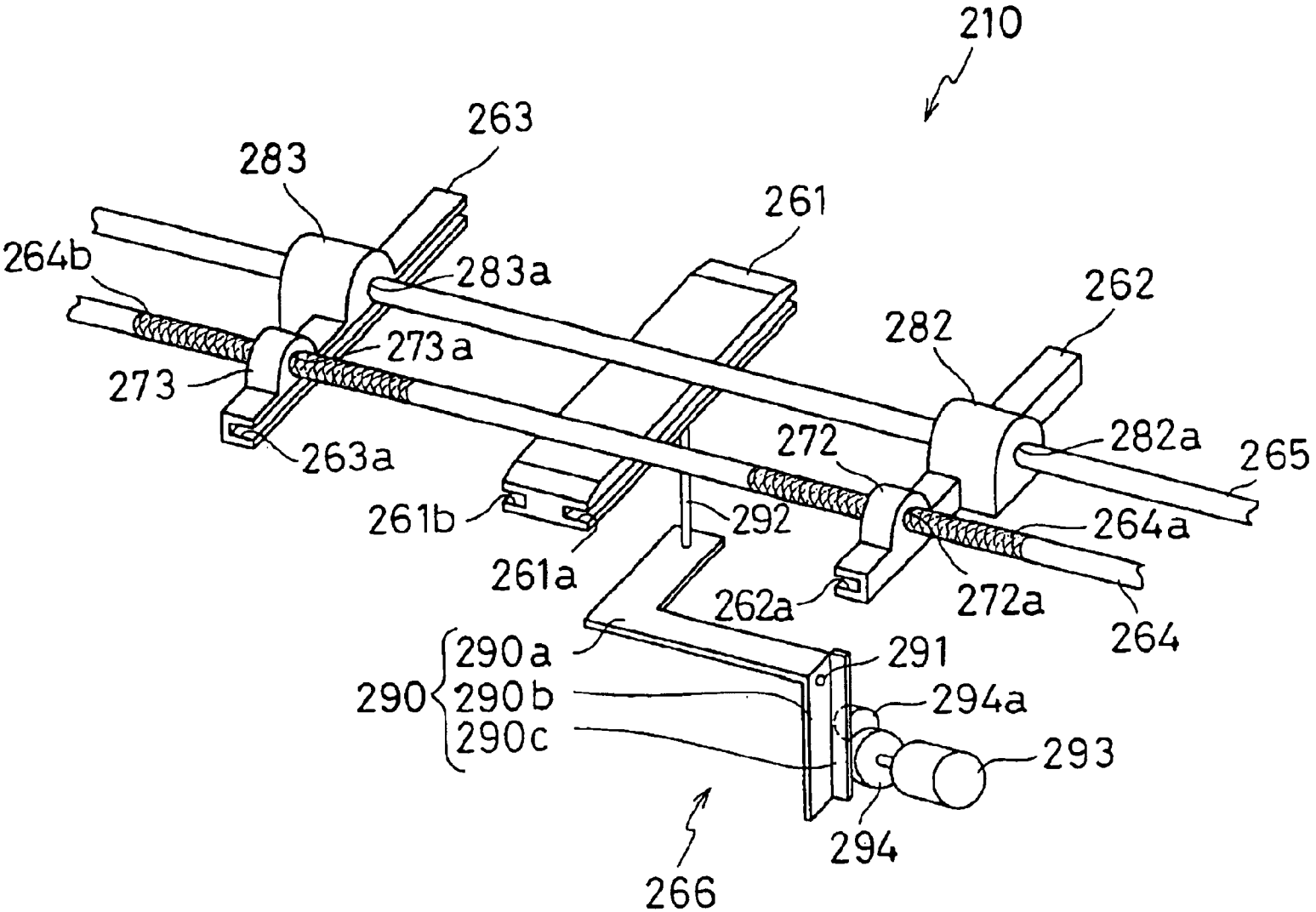
FIG. 9 is a general view of the guide mechanism included in the ink-jet printer shown in FIG. 7.
Figure 10:
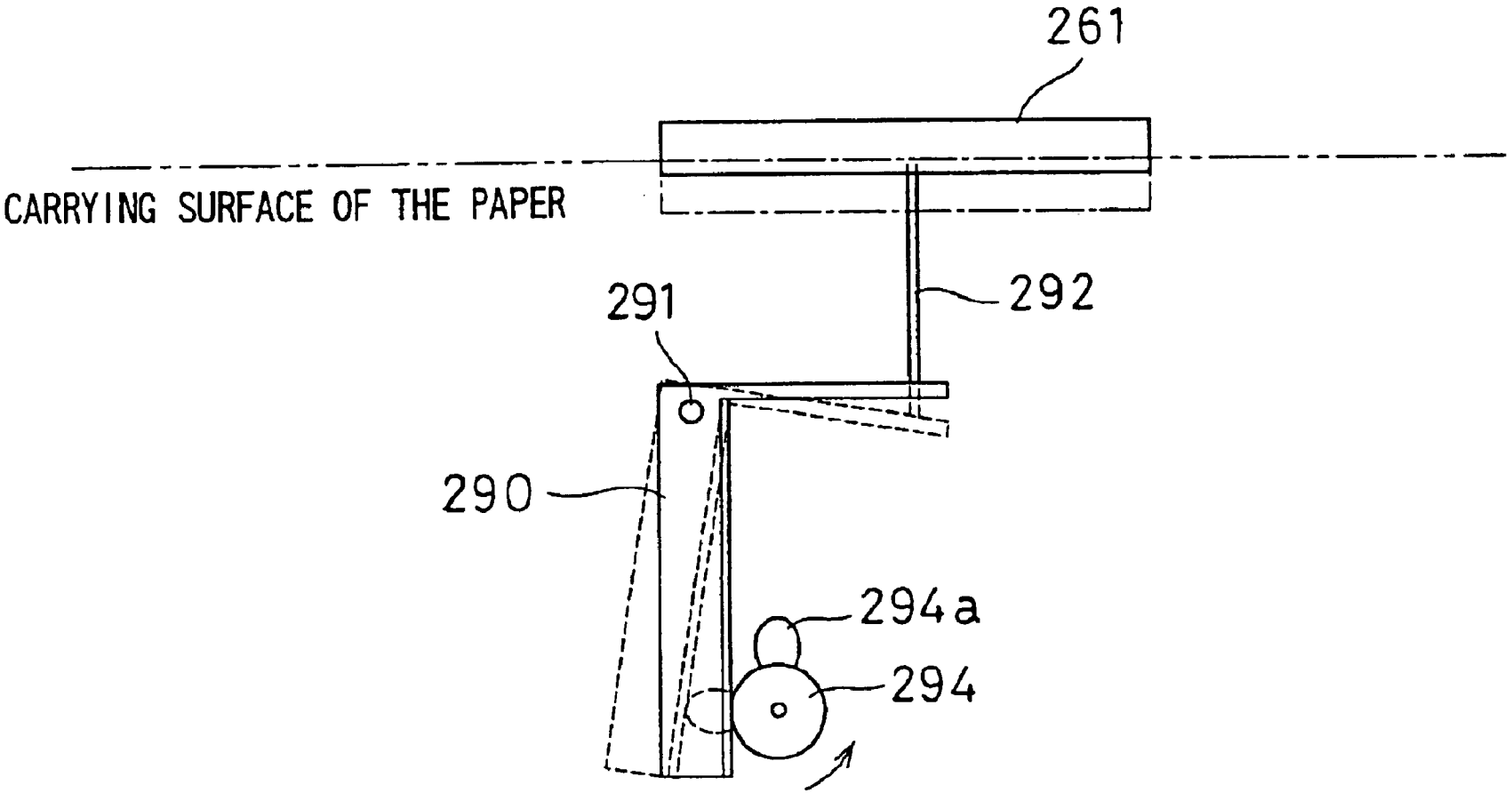
FIG. 10 is a view for description about a motion of a retracting mechanism of the guide mechanism illustrated in FIG. 9.
Figure 11:
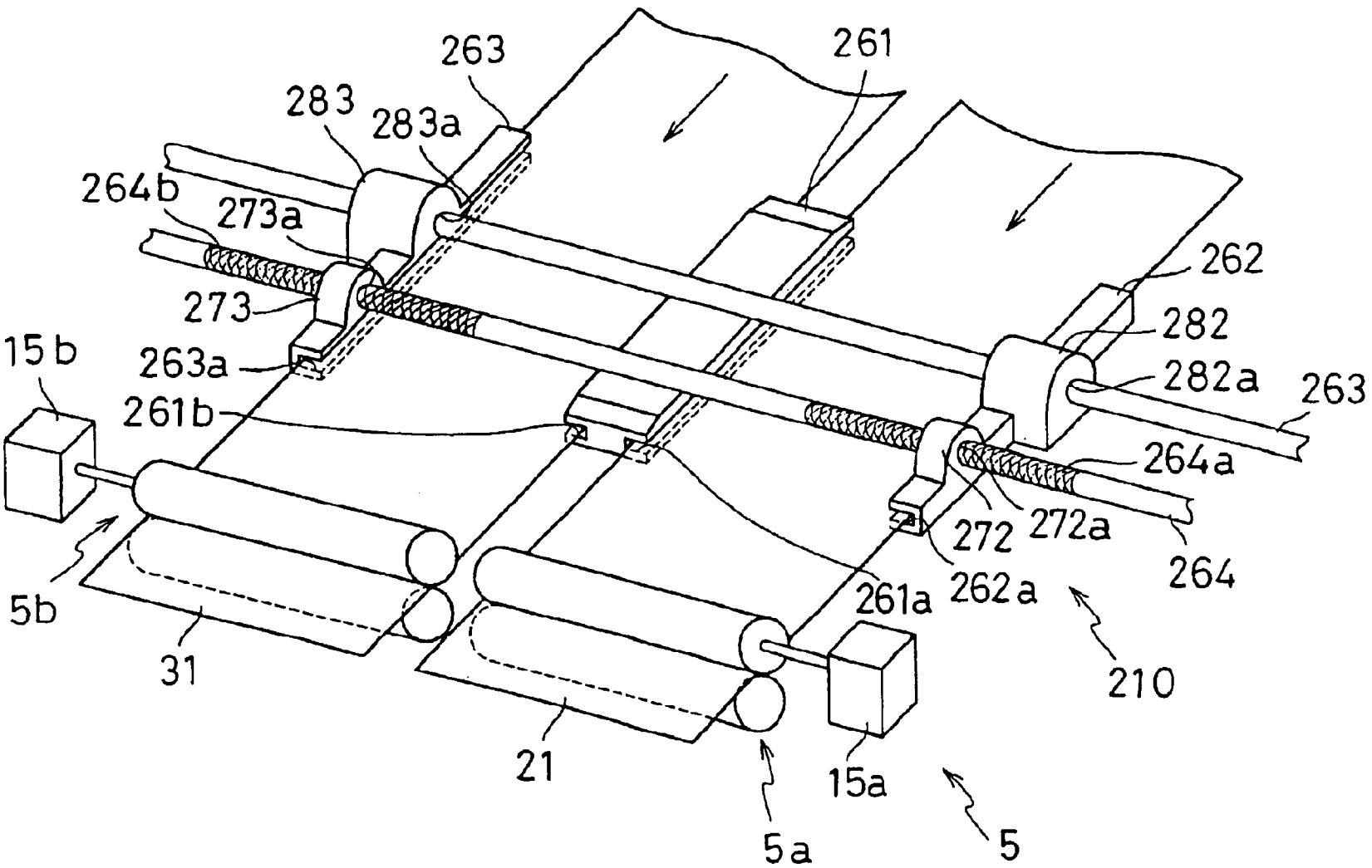
FIG. 11 is a view of the construction in the vicinity of the guide mechanism, in the case that two papers arranged in two rows are being carried.
Figure 12:
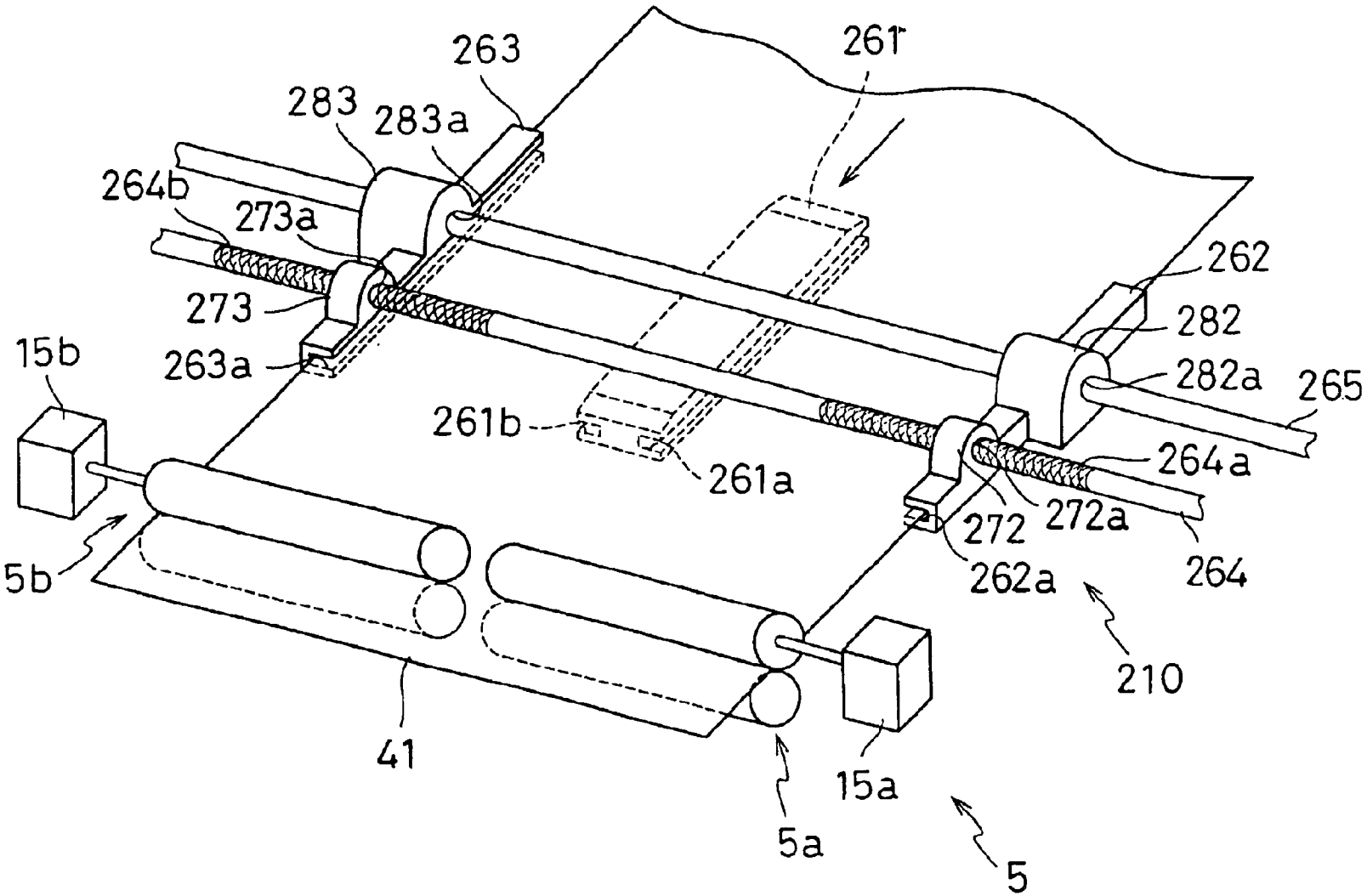
FIG. 12 is a view of the vicinity of the guide mechanism, in the case a single paper of a large width arranged in a single row is being carried.

FIG. 9 is a general view of the guide mechanism included in the ink-jet printer shown in FIG. 7. FIG. 10 is a view for description about a motion of a retracting mechanism of the guide mechanism illustrated in FIG. 9. FIG. 11 is a view of the construction in the vicinity of the guide mechanism, in the case that two papers arranged in two rows are being carried, and FIG. 12 is a view of the vicinity of the guide mechanism, in the case a single paper of a large width arranged in a single row is being carried. It is to be noted that FIG. 9 illustrates how the two papers 21, 31 arranged in two rows are carried.

The guide mechanism 210 has a center guide member 261, two movable guide members 262, 263, a feed shaft 264, a guide shaft 265, and a retracting mechanism 266 of the center guide member 261.

The center guide member 261 is a member having a generally rectangular parallelepiped shape and disposed at a widthwise center position of the guide mechanism 210. The guide mechanism 210 and the carrying table 12 of the ink-jet printing unit 6 are disposed to correspond in widthwise center position to each other. As mentioned later, when the papers 21, 31 are arranged and carried in two rows (FIG. 11), the center guide member 261 restricts the positions of the papers 21, 31 at their ends on the side thereof adjacent to each other. On the other hand, when the paper 41 is arranged and carried in a single row (FIG. 12), the center guide member 261 contacts with a side of the paper 41 on the side thereof opposite a printing side of the same.

The center guide member 261 is provided, on both widthwise sides thereof, with grooves 261*a*, 261*b* extending along the longitudinal direction thereof. The groove 261*a* is formed in the center guide member 261 at its side on the side thereof on which the paper 21 is carried (the near side in FIG. 9), and the groove 261*b* is formed in the center guide member 261 at its side on the side thereof on which the paper 31 is carried (the far side in FIG. 9). Accordingly, the center guide member 261 has a generally "H-shaped" section taken along line perpendicular to the longitudinal direction of the center guide member 261. When the papers 21, 31 are arranged in two rows, the papers 21, 31 are carried in the condition in which the ends of the papers 21, 31 on the side thereof adjacent to each other are inserted in their respective grooves 261*a* and 261*b* of the center guide member 261, so that the widthwise ends of the papers 21, 31 are restricted.

The movable guide members 262, 263 are a member having a generally rectangular parallelepiped shape to restrict the positions of the ends of the papers 21, 31 on the side thereof opposite the ends of the papers 21, 31 restricted by the center guide member 261. The movable guide members 262, 263 are disposed at the widthwise outside of the center guide member 261. The movable guide members 262, 263 are disposed at a widthwise center of the center guide member 261 or disposed symmetrically with respect to a position corresponding to the widthwise center position of the carrying table 12.

The movable guide members 262, 263 are provided, on both widthwise inner sides thereof, with grooves 262*a*, 263*a* extending along the longitudinal direction. Accordingly, the movable guide members 262, 263 each have a generally "U-shaped" section taken along line perpendicular to the longitudinal direction of the movable guide members 262, 263. The groove 262*a* of the movable guide member 262 is formed to confront the groove 261*a* of the center guide member 261, and the groove 263*a* of the movable guide member 263 is formed to confront the groove 261*b* of the center guide member 261. The grooves 261*a*, 261*b* of the center guide member 261 and the grooves 262*a*, 263*a* of the movable guide members 262, 263 are approximately level with each other and are disposed on the same plane as the carrying surfaces of the papers 21, 31. Accordingly, the papers 21, 31 are carried in the condition in which the ends of the papers 21, 31 on the widthwise outside of the guide mechanism 210 are inserted in the groove 262*a* of the movable guide member 262 and the groove 263*a* of the movable guide members 263, respectively, so that the positions of the widthwise ends of the papers 21, 31 are restricted.

The movable guide member 262 has, on its upper surface, protrusions 272, 282 formed to protrude upwardly, and the movable guide member 263 has, on its upper surface, protrusions 273, 283 formed to protrude upwardly. The protrusions 272, 273, 282, 283 each have a generally semi-cylinder shape and are disposed with their axial dimensions perpendicular to the longitudinal direction of the movable guide members 262, 263. The protrusions 272, 273 are substantially identical in size to each other, and the protrusions 282, 283 are substantially identical in size to each other. The protrusions 282, 283 have a diameter slightly larger than the protrusions 272, 273. The protrusions 272, 273, 282, 283 have through holes 272*a*, 273*a*, 282*a*, 283*a* formed around their shaft centers, respectively.

The feed shaft 264 and the guide shaft 265 are disposed above the center guide member 261 to be in parallel with each other along the main scanning direction. The feed shaft 264 and the guide shaft 265 are each held by supporting members (not shown) disposed at the axial outside of the movable guide members 262, 263. The feed shaft 264 is rotatable with respect to the supporting members.

Also, the feed shaft 264 has the function to convert the rotational motion to the linear motion along the main scanning direction. The feed shaft 264 has threaded feed portions 264*a*, 264*b*. The threaded feed portions 264*a*, 264*b* have predetermined widths, respectively, and are formed to be symmetric with respect to a widthwise center of the center guide member 261. The threaded feed portion 264*a* is disposed on the movable guide member 262 side (on the side on which the paper 21 is carried) with respect to the center guide member 261, and the threaded feed portion 264*b* is disposed on the movable guide member 263 side (on the side on which the paper 31 is carried) with respect to the center guide member 261.

The feed shaft 264 is inserted so that the threaded feed portions 264*a*, 264*b* can correspond to the through holes 272*a*, 273*a* of the protrusions 272, 273 formed in the movable guide members 262, 263, respectively. The threaded feed portions 264*a*, 264*b* have screw threads (not shown) threaded in the opposite direction to each other. Accordingly, when the feed shaft 264 is rotated, the movable guide members 262, 263 are moved in association with the feed shaft 264, so that it is moved inversely each other along the main scanning direction.

The guide shaft 265 is inserted in the through holes 282*a*, 283*a* of the protrusions 282, 283 formed in the movable guide members 262, 263. The guide shaft 254 has substantially the same diameter as the diameter of the through holes 282*a*, 283*a*. Accordingly, the movable guide members 262, 263 are moved along the guide shaft 265 in the main scanning direction, while an outer surface of the guide shaft 265 and inner surfaces of the through holes 282*a*, 283*a* are in contact with each other.

Thus, the movable guide members 262, 263 can be moved along the main scanning direction while keeping the movable guide members 262, 263 at the widthwise outside of the center guide member 261 symmetric with respect to the widthwise center of the center guide member 261 or with respect to the widthwise center of the carrying table 12. Accordingly, the distance between the center guide member 261 and the movable guide member 262 and the distance between the center guide member 261 and the movable guide member 263 is always kept substantially equal to each other.

According to this embodiment, when the paper 21, 31 having the same width are arranged and carried in two rows, as shown in FIG. 11, the movable guide members 262, 263 are moved along the main scanning direction to be in correspondence with the ends of the papers 21, 31 positioned at the widthwise outside of the carrying table 12 by rotating the feed shaft 264. As a result, the positions of the both widthwise ends of the paper 21 are restricted by the center guide member 261 and the movable guide member 262, and the positions of the both widthwise ends of the paper 31 are restricted by the center guide member 261 and the movable guide member 263. Then, the papers 21, 31 are held in sandwich relation by the pair of driving rollers 5*a*, 5*b* driven by the motors 15*a*, 15*b*, respectively, and are carried in the condition in which the positions of their both widthwise ends are restricted.

The retracting mechanism 266 is for moving the center guide member 261 up and down vertically and is disposed under the center guide member 261. Specifically, the retracting mechanism 266 can selectively switch the center guide member 261 between a position where that can restrict the widthwise position of the paper (a position where at least a part thereof locates on the substantially same plane as the carrying surface of the paper) and a position where the whole thereof does not locate on the substantially same plane as the carrying surface of the paper. The retracting mechanism 266 has a swinging member 290, a connecting member 293 and a cam 294.

The swinging member 290 comprises a horizontal portion 290*a*, a connecting portion 290*b* and a driving portion 290*c*. The horizontal portion 290*a*, the connecting portion 290*b* and the driving portion 290*c* are each formed by a plate-like member and are formed in one piece.

The horizontal portion 290*a* has a generally "L-shape" form and is disposed substantially horizontally, with its one end portion corresponding to a position under a generally center of the center guide member 261 and its other end portion corresponding to a position under the movable guide member 262. An upper surface of the horizontal portion 290*a* at one end portion thereof is connected with a lower surface of the center guide member 261 through a connecting member 292. An elastic member, such as a coiled spring having resilience, may be used as the connecting member 292 or alternatively a rod-like member having no elasticity may be used as the connecting member 292.

The connecting portion 290*b* is formed to extend vertically downwardly from the other end portion of the horizontal portion 290*a*. Accordingly, the connecting portion 290*b* is disposed to be on a plane orthogonal to the main scanning direction. The driving portion 290*c* is formed to extend vertically from one end portion of the connecting portion 290*b*. Accordingly, the driving portion 290*c* is disposed to be on a plane orthogonal to the sub scanning direction.

The swinging member 290 is provided with a rotation axis 291 at an upper end portion of the connecting portion 290*b*. Accordingly, the swinging member 290 can be swung about the rotation axis 291 as a fulcrum (See FIG. 10).

The motor 293 is disposed to be in the vicinity of a lower end portion of the driving portion 290*c* of the swinging member 290. The cam 294 is mounted on an output shaft of the motor 293. The cam 294 has a projection 294*a* projecting outwardly (upwardly in FIGS. 9 and 10) formed at one end portion thereof (an upper end portion in. FIGS. 9 and 10). The cam 294 is positioned so that when the papers 21, 31 are arranged and carried in two rows as shown in FIG. 9, a horizontal end of the cam 294 and the driving portion 290*c* of the swinging member 290 can be abutted with each other.

The retracting mechanism 266 of the guide mechanism 210 thus constructed can switch the center guide member 261 into either of the position where that can restrict the widthwise position of the paper or the position where the whole thereof does not locate on the substantially same plane as the carrying surface of the paper, as mentioned above. Accordingly, when the paper having a width larger than the width of the sum of the widths of the both papers 21, 31 is arranged and carried in a single row, the center guide member 261 can be retracted downwardly. The width of the paper 41 used in this embodiment has a width larger than the sum of the widths of the both papers 21, 31.

Specifically, when the motor 293 is driven to rotate the cam 294 in the counterclockwise direction so that the tip of the projection 294*a* of the cam 294 can abut with the driving portion 290*c* of the swinging member 290, as shown in FIG. 10, the driving portion 290*c* and the connecting portion 290*b* of the swinging member 290 are slanted and, as a result, the swinging member 290 is swung around the rotation axis 291 as the fulcrum. Then, the one end portion of the horizontal portion 290*a* of the swinging member 290 disposed under the center guide member 261 is moved downwardly and thereby the center guide member 261 is pulled down through the connecting member 292. The positions of the swinging member 290 and the projection 294*a* of the cam 294 displaced when the cam 294 is rotated in the counterclockwise direction are depicted in broken lines in FIG. 10. As a result, the center guide member 261 is retracted downwardly from its initial position (its horizontal position taken when the two papers 21, 31 are arranged and carried in two rows) to an extent corresponding to a predetermined height. The position of the center guide member 261 retracted downwardly is depicted in a chin line in FIG. 10.

On the other hand, when the motor 293 is driven to rotate the cam 294 in the clockwise direction so that the tip of the projection 294*a* of the cam 294 can be positioned above the cam 294 without abutting with the driving portion 290*c* of the swinging member 290, the swinging member 290 is swung in the opposite direction around the rotation axis 291 as the fulcrum and, as a result, the driving portion 290*c* and the connecting portion 290*b* of the swinging member 290 are returned to their original vertical positions. Then, the one end portion of the horizontal portion 290*a* of the swinging member 290 disposed under the center guide member 261 is moved upwardly and thereby the center guide member 261 is pushed up through the connecting member 292. As a result, the center guide member 261 is returned to its original position (its horizontal position taken when the two papers 21, 31 are arranged and carried in two rows).

In this embodiment, the predetermined height at which the center guide member 261 is retracted downwardly (difference in level between before the retraction of the center guide member 261 and after the retraction of the center guide member 261) is set so that the upper surface of the center guide member 261 retracted downwardly can be positioned on substantially the same plane as the carrying surface of the paper. In other words, the upper surface of the center guide member 261 retracted downwardly is in level with the carrying surface of the paper as depicted in a chain double-dashed line of FIG. 10. This can produce the result that when the paper 41 having the width larger than the sum of the widths of the papers 21, 31 is arranged and carried in a single row, the paper 41 can be carried with its back side contacting with the upper surface of the center guide member 261 positioned approximately at the widthwise center of the paper 41.

As just described, when the paper 41 having a large width is arranged and carried in a single row, the center guide member 261 is retracted downwardly by the retracting mechanism 266, first, and, then, the movable guide members 262, 263 are displaced along the widthwise direction of the paper 41 so that their positions can correspond to the both widthwise ends of the paper 41. As a result, the paper 41 is carried with its back side contacting with the upper surface of the center guide member 261 positioned approximately at the widthwise center of the paper 41, while its both widthwise ends are restricted by the movable guide members 262, 263. The paper 41 is carried, with its both sides held in sandwich relation by the pair of driving rollers 5*a*, 5*b* driven by the motors 15*a*, 15*b*. Accordingly, it is preferable that the motors 15*a*, 15*b* are controlled so that the distances the paper 41 is carried by the driving rollers 5*a* and 5*b* can be made equal to each other.

In this embodiment, the center guide member 261 need be retracted downwardly when the width of the paper 41 is larger than the distance between the groove 261*a* of the center guide member 261 and the groove 262*a* of the movable guide member 262 and the distance between the groove 261*b* of the center guide member 261 and the groove 263*a* of the movable guide member 263 defined when the movable guide members 262, 263 are moved to the widthwise outside of the threaded feed portions 264*a*, 264*b* of the feed shaft 264.

In this embodiment, either of the two paper lanes (two carrying passages) can be used to print an image on the paper. In addition to this, a single lane for printing an image on the paper of an irregular size can be made by loading the winding portion around which the paper of such an irregular size is wound on either of the two winding portions.

In this embodiment, in order to assist movement of the center guide member 261 when switched from the position the whole thereof does not locate on the substantially same plane as the carrying surface of the paper to the position where that can restrict the widthwise position of the paper, i,e., from its retracted position to its original upward position, an elastic member (not shown) to bias the center guide member 261 upwardly may additionally be arranged between the center guide member 261 and a supporting member (not shown) included in the guide mechanism 210.

As mentioned above, the guide mechanism 210 of the ink-jet printer 201 of this embodiment can provide the result that when the paper 41 having a width larger than the sum of the widths of the papers 21, 31 is arranged and carried in a single row, the center guide member 261 disposed around the widthwise center of the guide mechanism 210 can be retracted downwardly to switch the position of the center guide member 261 to the position where the whole thereof does not locate on the substantially same plane as the carrying surface of the paper 41. This can provide the result that the paper 41 of that irregular size can also be carried while the position of both widthwise ends of the paper 41 is restricted on the same plane as the carrying surface of the paper 41 by the movable guide members 262, 263.

Also, since the movable guide members 262, 263 are movable in the widthwise direction of the paper on the same plane as the carrying surface of the paper, their positions can be adjusted in accordance with the width of the paper. Therefore, the papers of different widths can be carried while their positions at both widthwise ends thereof are restricted properly.

In addition, the switching of the center guide member 261 from the position where that can restrict the widthwise position of the paper 41 to the position where the whole thereof does not locate on the substantially same plane as the carrying surface of the paper 41 and vice versa can be made simply by the retracting mechanism 266. Thus, the position change of the center guide member 261 in accordance with various papers of different widths can be made quickly and easily.

Further, since the upper surface of the center guide member 261 retracted downwardly by the retracting mechanism 266 is approximately in level with the carrying surface of the paper, the upper surface of the center guide member 261 is put in contact with the back side of the paper 41. Therefore, the papers of different widths can be carried while their positions at both widthwise ends thereof are restricted further properly on the carrying surface of the paper.

While the carriage of the papers 21, 31 of the same width arranged in two rows has been described in the first and second embodiments, a single paper arranged in a single row may be carried or three or more papers arranged in three or more rows may be carried. In the first embodiment, two papers of different in width from each other may be carried in two rows. When the papers are arranged and carried in three or more rows, any combination of the widths of the papers can be selected. It is preferable that the guide mechanism is structured so that the movable guide members can be changed in position arbitrarily so that they can positioned in correspondence with the both widthwise ends of the papers of different widths, in the case the papers are arranged and carried in three or more rows. For the rimless printing on various papers having different widths, the ink receiving portions need be provided in the carriage in advance to correspond to those various papers.

While the fixed guide member 61 formed in one piece to serve as a common guide member for restricting the positions of the papers 21, 31 at ends thereof in the vicinity of widthwise center of the guide supporting plate 60 has been described in the first embodiment, the fixed guide member may be formed by separate members to restrict the positions of the ends of the papers 21, 31 separately. Similarly, in the second embodiment as well, the fixed guide members 171, 172 for restricting the positions of the both ends of the papers 21, 31 need not necessarily be provided in the same member of the fixed guide supporting member 161, and the movable guide portions 173, 174 need not necessarily be provided in the same member of the movable guide supporting plate 162. The fixed guide portion and the movable guide portion may be provided in separate members, respectively.

Also, while the guide mechanism 10, 110 disposed between the paper supply unit 2 and the advance roller unit 4 has been described in the first and second embodiments, the position where the guide mechanism 10, 110 is arranged may be changed arbitrarily. The guide mechanism 10, 110 may be disposed, for example, between the advance roller unit 4 and the carrying roller unit 5, between the ink-jet printing unit 6 and the cutting unit 8, or downstream of the cutting unit 8.

Also, while the guide mechanism 210 that can carry the papers 21, 31 arranged in two rows while restricting the positions of the both widthwise ends of the papers 21, 31 by the center guide member 261 having the grooves 261*a*, 261*b* and immovable in the widthwise direction of the paper and the movable guide members 262, 263 having the grooves 262*a*, 263*a* formed to correspond to the grooves 261*a*, 261*b* and movable in the widthwise direction of the paper has been described in the third embodiment, the construction of the guide mechanism may be changed arbitrarily without being limited thereto. The guide mechanism may be modified so that the papers arranged in three or more rows can be carried by the guide mechanism. In this modification, however, the required number of guide members for restricting the positions of the both widthwise ends of the respective papers arranged in three or more rows are needed. When a number of guide members are arranged on substantially same plane as the carrying surface of the paper, with spaced from each other along the widthwise direction of paper, various papers of different width can be carried while the positions of the papers at the both widthwise ends thereof are restricted properly.

While in the third embodiment, the center guide member 261 is unmovable in the widthwise direction of the paper, while on the other hand, only the movable guide members 262, 263 are movable in the widthwise direction of the paper, those guide members may all be unmovable or movable in the widthwise direction of the paper. However, in the case where the guide members may all be unmovable in the widthwise direction of the paper, it is preferable that the papers carried have substantially the same widths as the distances between the guide members.

While the center guide member 261 of the third embodiment is formed in one piece to serve as a common guide member for restricting the positions of the papers 21, 31 arranged and carried in two rows at ends thereof on the side thereof adjacent to each other, the guide member may be formed by separate members to restrict the positions of the ends of the papers 21, 31 separately.

While the third embodiment is structured so that the grooves 261*a*, 261*b* and the grooves 262*a*, 263*a* are formed in the center guide member 261 and the movable guide members 262, 263, respectively, those grooves need not necessarily be provided. However, in this case, different supporting members for supporting the papers on the carrying surfaces must be provided.

Also, while the construction wherein the movable guide members 262, 263 are moved by the feed shaft 264 constructed to move the guide members in association inversely each other along the widthwise direction of the paper has been described in the third embodiment, the movable guide members 262, 263 may be moved by separately provided moving mechanisms. This allows the carriage of the two papers different in width from each other while restricting the positions of both widthwise ends of those papers properly.

Also, while the retracting mechanism 266 which is constructed to retract the center guide member 261 downwardly so as to switch the center guide member 261 from the position on the carrying surface of the paper to the position where the whole thereof does not locate on the substantially same plane as the carrying surface of the paper has been described in the third embodiment, the construction of the retracting mechanism 266 to switch the center guide member 261 from the position where that can restrict the widthwise position of the paper to the position where the whole of thereof does not locate on the substantially same plane as the carrying surface of the paper may be changed arbitrarily. The center guide member may be retracted in any directions other than the upward direction. Also, the position of the center guide member need not necessarily be switched by the retracting mechanism, but may be switched by hand.

While the construction wherein the center guide member 261 retracted downwardly by the retracting mechanism 266 is put into contact with the back side of the paper 41 has been described in the third embodiment, the center guide member retracted by the retracting mechanism need not necessarily be put in contact with the back side of the paper 41. The center guide member retracted by the retracting mechanism may be put into contact with the print side of the paper.

Also, while the guide mechanism 210 disposed between the advance roller unit 4 and the carrying roller unit 5 has been described in the third embodiment, the position where the guide mechanism 210 is arranged may be changed arbitrarily, without being limited thereto. The guide mechanism 210 may be disposed, for example, between the paper supply unit 2 and the advance roller unit 4, between the ink-jet printing unit 6 and the cutting unit 8, or downstream of the cutting unit 8.

While the head block 44 movable in reciprocation over the entire printable range to print the image has been described in the first to third embodiments, the head block may take a line form fixed and arranged over the entire printable range, without being limited thereto.

While the first to third embodiments refer to the ink-jet printer, the invention is applicable to other image forming apparatuses than the ink-jet printer, such as a photo-processing apparatus for forming a latent image of the image by exposing photographic printing paper to light, without limiting thereto.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus comprising:

moving means for moving an image-forming medium;

a plate for supporting a first position restricting member and a second position restricting member;

said first position restricting member restricts a position of one widthwise end of the image-forming medium and said first position restricting member is disposed in a predetermined position on said plate;

said second position restricting member being movable in a widthwise direction of the image-forming medium, said second position restricting member restricts a position of the other widthwise end of the image-forming medium; and an image-forming member for forming an image on the image-forming medium, the positions of both of the widthwise ends of the image-forming medium being restricted by said first position restricting member and said second position restricting member.

2. The image forming apparatus according to claim 1, further comprising a third position restricting member, wherein said moving means for moving includes means for moving a plurality of image-forming media arranged substantially parallel to each other, and wherein said first position restricting member includes two restricting portions, said two restricting portions, said second position restricting member and said third position restricting member restrict two image-forming media arranged adjacent to each other, and wherein said two restricting portions are integral with each other.

3. The image forming apparatus according to claim 1, wherein said moving means for moving includes means for moving a plurality of image-forming media arranged substantially parallel to each other, wherein said image-forming member forms an image while the plurality of image-forming media moves in a direction of said moving means, and wherein said first position restricting member includes two restricting portions that restrict positions of opposite widthwise ends of the plurality of image-forming media, said two restricting portions of said first position restricting member restrict the plurality of image-forming media arranged adjacent to each other.

4. The image forming apparatus according to claim 3, wherein said first position restricting member can selectively take a first position where at least a part of said first position restricting member is located in substantially a common plane as the image-forming media and a second position where said first position restricting member is spaced from the common plane.

5. An image forming apparatus comprising:

moving means for moving an image-forming medium; and at least three position restricting members, each of said at least three position restricting members being spaced from one another along a widthwise direction of the image-forming medium so that a first position restricting member is disposed between a second position restricting member and a third position restricting member of said at least three position restricting members, wherein said first position restricting member can selectively take a first position where at least a part of said first position restricting member is located in substantially a common plane as the image-forming medium and a second position where said first position restricting member is spaced from the common plane.

6. The image forming apparatus according to claim 5, wherein at least one of said at least three position restricting members is movable in a widthwise direction of the image-forming medium.

7. The image forming apparatus according to claim 5, wherein said first position restricting member restricts positions of opposite widthwise ends of two image-forming media arranged adjacent to each other.

8. The image forming apparatus according to claim 5, further comprises a switching means for moving said first position restricting member between the first position and the second position.

9. The image forming apparatus according to claim 8, wherein when said first position restricting member is disposed in the second position, said first position restricting member abuts with at least one of an image-forming side and an opposite side of the image-forming medium.

* * * * *